US009504326B1

(12) United States Patent
Cartis et al.

(10) Patent No.: US 9,504,326 B1
(45) Date of Patent: Nov. 29, 2016

(54) RECLINING CHAIR

(71) Applicant: Humanscale Corporation, New York, NY (US)

(72) Inventors: Emilian Cartis, Brooklyn, NY (US); Mark McKenna, New York, NY (US)

(73) Assignee: Humanscale Corporation, New York, NY (US)

( * ) Notice: Subject to any disclaimer, the term of this patent is extended or adjusted under 35 U.S.C. 154(b) by 89 days.

(21) Appl. No.: 13/860,421

(22) Filed: Apr. 10, 2013

Related U.S. Application Data

(60) Provisional application No. 61/622,358, filed on Apr. 10, 2012, provisional application No. 61/625,373, filed on Apr. 17, 2012.

(51) Int. Cl.
*A47C 1/024* (2006.01)

(52) U.S. Cl.
CPC ..... *A47C 1/024* (2013.01)

(58) Field of Classification Search
USPC ..... 297/354.1, 354.11
See application file for complete search history.

(56) References Cited

U.S. PATENT DOCUMENTS

| | | | | |
|---|---|---|---|---|
| 242,733 | A * | 6/1881 | Yengling | 297/61 |
| 2,126,439 | A | 8/1938 | Zerbee | |
| 2,324,902 | A | 7/1943 | Benzick et al. | |
| 2,456,797 | A | 12/1948 | Sheldrick | |
| 2,473,895 | A | 6/1949 | Mednick | |
| 2,497,395 | A | 2/1950 | Cramer, Sr. | |
| 2,638,149 | A | 5/1953 | Janosek | |
| 2,778,408 | A | 1/1957 | Krikorian | |
| 2,838,095 | A | 6/1958 | Deaton | |
| 2,859,799 | A | 11/1958 | Moore | |

(Continued)

FOREIGN PATENT DOCUMENTS

| | | | |
|---|---|---|---|
| CN | 101431923 | A | 5/2009 |
| DE | 4023607 | A1 | 1/1992 |

(Continued)

OTHER PUBLICATIONS

PCT Application No. US2007/67316; International Search Report and Written Opinion of the International Searching Authority for Applicant Humanscale Corporation dated Dec. 28, 2007.

(Continued)

*Primary Examiner* — Timothy J Brindley
(74) *Attorney, Agent, or Firm* — Jones Walker LLP

(57) ABSTRACT

A reclinable chair featuring a weight-sensitive recline mechanism is disclosed. The reclinable chair can comprise a base a support frame pivotally mounted to the base, and a support surface mounted to the support frame. The support frame can include a seat frame portion disposed between and pivotally connected to both a front frame portion and a back frame portion. The back frame portion of the support frame can also be pivotally attached to a rear end of the base, while the front frame portion can also be pivotally attached to a front end of the base. In this arrangement, the support frame and the base can cooperatively function as a linkage system capable of providing a weight-sensitive recline mechanism in a low-profile, stackable chair. The reclinable chair of the present invention can also feature a support surface featuring a pattern of openings shaped by a plurality of higher pitch curvilinear segments to provide greater flexibility and a pattern of openings shaped by a plurality of lower pitch, straighter segments to provide less flexibility.

16 Claims, 21 Drawing Sheets

(56) References Cited

U.S. PATENT DOCUMENTS 2,859,801 A 11/1958 Moore
2,991,125 A 7/1961 Lie
3,041,109 A 6/1962 Eames et al.
3,205,010 A 9/1965 Schick
3,333,811 A 8/1967 Matthews
3,337,267 A 8/1967 Rogers, Jr.
3,399,906 A 9/1968 Portnoff
3,446,532 A * 5/1969 Cramer ..... 297/312
3,450,435 A 6/1969 Stephens
3,489,458 A 1/1970 Karlsen
3,540,776 A 11/1970 Wilson
3,572,829 A 3/1971 Malitte
3,630,572 A 12/1971 Homier
3,709,557 A 1/1973 Light
3,712,666 A * 1/1973 Stoll ..... 297/61
3,774,967 A 11/1973 Rowland
3,815,955 A 6/1974 Gibilterra
3,904,242 A 9/1975 Koepke et al.
3,916,461 A 11/1975 Kerstholt
3,924,893 A 12/1975 Ferrara
3,939,565 A 2/1976 Bush
3,947,069 A 3/1976 Lusch
D246,813 S 1/1978 Tolleson
4,068,888 A 1/1978 Bottemiller
4,084,850 A 4/1978 Ambasz
4,234,226 A 11/1980 Colby
4,270,798 A 6/1981 Harder, Jr.
4,362,336 A 12/1982 Zapf et al.
4,379,589 A 4/1983 Marino
4,408,800 A 10/1983 Knapp
4,411,469 A 10/1983 Drabert et al.
4,429,917 A 2/1984 Diffrient
4,451,085 A 5/1984 Franck et al.
4,452,486 A 6/1984 Zapf et al.
D274,675 S 7/1984 Diffrient
4,478,454 A 10/1984 Faiks
4,479,679 A 10/1984 Fries et al.
4,502,729 A 3/1985 Locher
4,522,444 A 6/1985 Pollock
4,555,139 A 11/1985 Lieb
4,583,778 A 4/1986 Liebhold
4,603,907 A 8/1986 Witzke
4,609,225 A 9/1986 Loucks
4,618,185 A 10/1986 Kaufman
4,639,042 A 1/1987 Lange
4,640,548 A 2/1987 Desanta
4,685,730 A * 8/1987 Linguanotto ..... 297/316
4,709,962 A 12/1987 Steinmann
4,709,963 A 12/1987 Uecker et al.
4,732,424 A * 3/1988 Uredat-Neuhoff ..... 297/317
4,733,910 A 3/1988 Brennan
4,744,603 A 5/1988 Knoblock
4,761,033 A 8/1988 Lanuzzi et al.
4,765,679 A 8/1988 Lanuzzi et al.
4,773,706 A 9/1988 Hinrichs
4,776,633 A 10/1988 Knoblock et al.
4,796,952 A 1/1989 Piretti
4,830,430 A 5/1989 Schafer
4,842,333 A 6/1989 Meiller
4,856,846 A 8/1989 Lohmeyer
4,877,291 A 10/1989 Taylor
4,883,320 A 11/1989 Izumida et al.
4,889,385 A 12/1989 Chadwick et al.
4,892,355 A 1/1990 Fend
D308,143 S 5/1990 Lohmeyer
4,938,530 A 7/1990 Snyder et al.
4,943,114 A 7/1990 Piretti
4,966,411 A 10/1990 Katagiri et al.
4,988,145 A * 1/1991 Engel ..... 297/300.4
4,997,234 A 3/1991 Royle et al.
5,009,466 A * 4/1991 Perry ..... 297/323
5,013,089 A 5/1991 Abu-Isa et al.
5,015,031 A 5/1991 Horenkamp
5,018,791 A 5/1991 Zapf
5,035,466 A 7/1991 Mathews et al.
5,076,646 A 12/1991 Matte
5,080,318 A 1/1992 Takamatsu et al.
5,123,702 A 6/1992 Caruso
5,150,948 A 9/1992 Volkle
5,195,801 A 3/1993 Franck et al.
D339,940 S 10/1993 Balderi et al.
5,251,958 A 10/1993 Roericht et al.
5,261,723 A 11/1993 Hosoe
5,267,777 A 12/1993 Valtri
5,288,138 A 2/1994 Stulik et al.
5,292,097 A 3/1994 Russell
5,292,177 A 3/1994 Balderi et al.
5,308,144 A 5/1994 Korn
5,314,237 A 5/1994 Koepke et al.
5,314,240 A 5/1994 Ishi et al.
5,338,094 A 8/1994 Perry
5,338,099 A 8/1994 Ishi et al.
5,354,120 A 10/1994 Volkle
5,366,274 A 11/1994 Roericht et al.
5,383,712 A 1/1995 Perry
5,393,120 A 2/1995 Woods et al.
5,393,126 A 2/1995 Boulva
5,401,077 A 3/1995 Hosoe
5,486,035 A 1/1996 Koepke et al.
5,503,455 A 4/1996 Yang
5,524,966 A 6/1996 Piretti
5,549,358 A 8/1996 Muller
5,577,807 A 11/1996 Hodge et al.
5,580,127 A 12/1996 Piretti
5,582,459 A 12/1996 Hama et al.
5,603,551 A 2/1997 Sheehan
5,660,439 A 8/1997 Unwalla
5,662,381 A 9/1997 Roossien et al.
5,683,142 A 11/1997 Gunderson et al.
5,686,035 A 11/1997 Tornero
D390,024 S 2/1998 DeJule
5,716,099 A * 2/1998 McDiarmid ..... 297/302.1
5,716,101 A 2/1998 Frinier et al.
5,725,276 A 3/1998 Ginat
5,725,277 A 3/1998 Knoblock
5,747,140 A 5/1998 Heerklotz
5,755,488 A 5/1998 Beda et al.
5,772,282 A 6/1998 Stumpf et al.
5,775,774 A 7/1998 Okano
5,785,384 A 7/1998 Sagstuen
5,806,930 A 9/1998 Knoblock
5,810,440 A 9/1998 Unwalla
5,823,626 A 10/1998 Haas
5,826,940 A 10/1998 Hodgdon
5,842,739 A 12/1998 Noble
5,845,970 A 12/1998 Schwartz
5,862,874 A 1/1999 Brienza et al.
5,899,531 A 5/1999 Koehler
5,902,012 A 5/1999 Han
5,904,397 A * 5/1999 Fismen ..... 297/291
D410,808 S 6/1999 Baumann et al.
5,924,770 A 7/1999 Tarnay et al.
D412,622 S 8/1999 DeJule
5,931,531 A 8/1999 Assmann
5,944,382 A 8/1999 Ambasz
RE36,335 E 10/1999 Perry
5,964,473 A 10/1999 Degonda et al.
5,964,503 A 10/1999 Inoue
D415,912 S 11/1999 Baumann et al.
D416,407 S 11/1999 Baumann et al.
5,988,757 A 11/1999 Vishey et al.
D417,570 S 12/1999 Baumann et al.
6,000,755 A 12/1999 Uhlenbrock
6,003,942 A 12/1999 Haas
6,003,948 A 12/1999 Holbrook
6,012,774 A 1/2000 Potter
D420,540 S 2/2000 Baumann et al.
6,035,901 A 3/2000 Stumpf et al.
6,050,646 A 4/2000 Stenzel et al.
6,059,368 A 5/2000 Stumpf et al.
6,086,153 A 7/2000 Heidmann et al.
6,102,482 A 8/2000 Dettoni et al.
6,109,694 A 8/2000 Kurtz
6,113,186 A 9/2000 Holmes et al.

(56) References Cited

U.S. PATENT DOCUMENTS

| | | | | |
|---|---|---|---|---|
| 6,125,521 | A | 10/2000 | Stumpf et al. | |
| D435,746 | S | 1/2001 | Diffrient | |
| 6,168,233 | B1 | 1/2001 | Markus | |
| 6,217,114 | B1 | 4/2001 | Degonda | |
| 6,234,573 | B1 | 5/2001 | Roder et al. | |
| 6,234,578 | B1 | 5/2001 | Barton et al. | |
| 6,238,000 | B1 | 5/2001 | Hallmark et al. | |
| 6,247,753 | B1 | 6/2001 | Alvestad | |
| 6,296,312 | B1 | 10/2001 | Congleton et al. | |
| 6,311,939 | B1 | 11/2001 | Christensen | |
| D453,633 | S | 2/2002 | Diffrient | |
| D455,570 | S | 4/2002 | Kita | |
| D456,627 | S | 5/2002 | Pearce et al. | |
| D457,739 | S | 5/2002 | Pearce et al. | |
| 6,386,634 | B1 | 5/2002 | Stumpf et al. | |
| 6,386,636 | B2 | 5/2002 | Caruso et al. | |
| 6,394,549 | B1 | 5/2002 | DeKraker et al. | |
| 6,439,665 | B1 | 8/2002 | Cvek | |
| D464,208 | S | 10/2002 | Kwon | |
| 6,460,932 | B1 | 10/2002 | Kopish et al. | |
| 6,523,896 | B1 | 2/2003 | Uhlenbrock | |
| 6,540,950 | B1 | 4/2003 | Coffield | |
| 6,550,866 | B1 | 4/2003 | Su | |
| 6,561,580 | B1 | 5/2003 | Bergey | |
| 6,568,760 | B2 | 5/2003 | Davis et al. | |
| 6,585,323 | B2 | 7/2003 | Gaylord et al. | |
| 6,588,842 | B2 | 7/2003 | Stumpf et al. | |
| 6,604,784 | B1 | 8/2003 | Bosman et al. | |
| 6,634,717 | B2 | 10/2003 | Kown | |
| 6,641,214 | B2 | 11/2003 | Veneruso | |
| 6,644,741 | B2 | 11/2003 | Nelson et al. | |
| 6,669,143 | B1 | 12/2003 | Johnson | |
| 6,679,553 | B2 | 1/2004 | Battey et al. | |
| 6,685,267 | B1 | 2/2004 | Johnson et al. | |
| 6,688,698 | B1 | 2/2004 | Chou et al. | |
| 6,692,075 | B2 | 2/2004 | Sander et al. | |
| 6,702,390 | B2 | 3/2004 | Stumpf et al. | |
| 6,709,057 | B2 | 3/2004 | Sander et al. | |
| 6,709,058 | B1 | 3/2004 | Diffrient | |
| 6,722,735 | B2 | 4/2004 | Lucci et al. | |
| 6,722,741 | B2 | 4/2004 | Stumpf et al. | |
| 6,722,742 | B2 | 4/2004 | Potes et al. | |
| 6,726,286 | B2 | 4/2004 | Sayers et al. | |
| 6,729,688 | B2 | 5/2004 | Erne | |
| 6,729,691 | B2 | 5/2004 | Koepke et al. | |
| 6,733,080 | B2 | 5/2004 | Stumpf et al. | |
| 6,752,411 | B2 | 6/2004 | Few | |
| 6,796,568 | B2 | 9/2004 | Martis et al. | |
| 6,802,568 | B1 | 10/2004 | Johnson | |
| 6,817,668 | B2 | 11/2004 | DeKraker et al. | |
| 6,837,539 | B1 | 1/2005 | Casey | |
| 6,837,545 | B1 | 1/2005 | Ho | |
| 6,837,546 | B2 | 1/2005 | VanDeRiet et al. | |
| 6,874,853 | B2 | 4/2005 | Wild | |
| 6,886,890 | B2 | 5/2005 | Rowland et al. | |
| 6,890,030 | B2 | 5/2005 | Wilkerson et al. | |
| 6,896,329 | B2 | 5/2005 | Sander et al. | |
| 6,908,159 | B2 * | 6/2005 | Prince et al. | 297/452.23 |
| D507,909 | S | 8/2005 | Grove | |
| 6,923,505 | B2 | 8/2005 | Siminovitch et al. | |
| 6,935,690 | B2 | 8/2005 | Lucci et al. | |
| 6,942,300 | B2 | 9/2005 | Numa et al. | |
| 6,945,602 | B2 | 9/2005 | Fookes et al. | |
| 6,959,965 | B2 | 11/2005 | Diffrient | |
| 6,966,606 | B2 | 11/2005 | Coffield | |
| 6,983,997 | B2 | 1/2006 | Wilkerson et al. | |
| 7,004,543 | B2 | 2/2006 | Caruso et al. | |
| 7,014,261 | B2 | 3/2006 | Haney | |
| 7,014,269 | B2 | 3/2006 | Coffield et al. | |
| 7,021,712 | B2 * | 4/2006 | Spendlove et al. | 297/285 |
| 7,040,429 | B2 | 5/2006 | Molnar | |
| 7,055,634 | B2 | 6/2006 | Molnar | |
| 7,114,782 | B2 | 10/2006 | Ambasz | |
| 7,118,177 | B2 | 10/2006 | Piretti | |
| 7,159,943 | B2 | 1/2007 | Costaglia | |
| 7,234,777 | B2 | 6/2007 | Schweikarth et al. | |
| 7,390,060 | B2 | 6/2008 | Kristen | |
| D575,960 | S | 9/2008 | Su | |
| 7,419,182 | B2 | 9/2008 | Goertzen et al. | |
| 7,419,222 | B2 | 9/2008 | Schmitz et al. | |
| 7,425,037 | B2 | 9/2008 | Schmitz et al. | |
| 7,472,767 | B2 | 1/2009 | Molnar | |
| 7,472,957 | B2 * | 1/2009 | Ferry et al. | 297/343 |
| D587,915 | S | 3/2009 | Igarashi | |
| 7,500,718 | B2 | 3/2009 | Fookes | |
| 7,513,569 | B2 | 4/2009 | Curiger | |
| 7,566,097 | B2 | 7/2009 | Sander et al. | |
| 7,717,515 | B2 | 5/2010 | Saez et al. | |
| 7,726,740 | B2 | 6/2010 | Masunaga | |
| 7,770,979 | B2 | 8/2010 | He | |
| 7,828,390 | B2 | 11/2010 | Liu et al. | |
| 8,061,775 | B2 | 11/2011 | Diffrient | |
| D660,056 | S | 5/2012 | Diffrient | |
| D661,135 | S | 6/2012 | Diffrient | |
| 8,714,645 | B2 * | 5/2014 | Cvek | 297/301.4 |
| 8,777,312 | B2 * | 7/2014 | Diffrient | 297/318 |
| 8,876,209 | B2 * | 11/2014 | Peterson et al. | 297/284.1 |
| 2001/0028188 | A1 | 10/2001 | Stumpf et al. | |
| 2001/0030457 | A1 | 10/2001 | Gregory | |
| 2002/0167208 | A1 | 11/2002 | Sander et al. | |
| 2002/0190563 | A1 | 12/2002 | Davis et al. | |
| 2003/0001420 | A1 | 1/2003 | Koepke et al. | |
| 2003/0071509 | A1 | 4/2003 | Neil et al. | |
| 2003/0184140 | A1 | 10/2003 | Bruske | |
| 2003/0214171 | A1 | 11/2003 | Burwell | |
| 2003/0234561 | A1 | 12/2003 | Zheng | |
| 2004/0090104 | A1 | 5/2004 | Seibold | |
| 2004/0189073 | A1 | 9/2004 | Chadwick et al. | |
| 2005/0116519 | A1 | 6/2005 | Wullum | |
| 2005/0258678 | A1 | 11/2005 | Wilkerson et al. | |
| 2005/0275265 | A1 | 12/2005 | Deimen et al. | |
| 2006/0022506 | A1 | 2/2006 | Chan | |
| 2006/0103221 | A1 | 5/2006 | Kleist | |
| 2006/0103222 | A1 | 5/2006 | Caruso et al. | |
| 2006/0290182 | A1 | 12/2006 | Moreschi | |
| 2007/0001497 | A1 | 1/2007 | Diffrient | |
| 2007/0210634 | A1 | 9/2007 | Krehm et al. | |
| 2009/0152930 | A1 | 6/2009 | Diffrient | |
| 2010/0244515 | A1 | 9/2010 | Ivicevic | |
| 2011/0101748 | A1 | 5/2011 | Goetz | |
| 2012/0098313 | A1 | 4/2012 | Cartis et al. | |

FOREIGN PATENT DOCUMENTS

| | | | |
|---|---|---|---|
| DE | 4033972 | A1 | 4/1992 |
| DE | 29707354 | U1 | 6/1997 |
| DE | 10051840 | A1 | 5/2002 |
| DE | 102006033049 | A1 | 1/2008 |
| EP | 1327400 | A2 | 7/2003 |
| EP | 1327400 | A3 | 4/2004 |
| EP | 1576905 | A1 | 9/2005 |
| GB | 577369 | A | 5/1946 |
| GB | 1291263 | A | 10/1972 |
| GB | 1428185 | | 3/1976 |
| JP | 5764014 | | 4/1982 |
| JP | 61247418 | A | 11/1986 |
| JP | 083364535 | A | 12/1996 |
| JP | 20011008785 | A | 1/2001 |
| RU | 2310361 | C2 | 5/2005 |
| WO | 9303653 | A1 | 3/1993 |
| WO | 0074531 | A2 | 12/2000 |
| WO | 0193907 | A1 | 12/2001 |
| WO | 2004037046 | A1 | 5/2004 |
| WO | 2005112704 | A2 | 12/2005 |
| WO | 2005112704 | A3 | 12/2005 |
| WO | 2007127740 | A2 | 11/2007 |
| WO | 2008020824 | A3 | 2/2008 |

OTHER PUBLICATIONS

PCT Application No. US2007/67316; International Preliminary Report on Patentability for Applicant Humanscale Corporation dated Jul. 28, 2008.

(56) References Cited

OTHER PUBLICATIONS

ROSTA Info, Quarterly published customer information of ROSTA AG, CH-5502, Hunzenschwil; No. 3/2005.
ROSTA Technology brochure, pp. 6-12.
The Blue Ones from ROSTA brochure, ROSTA, Inc.
PCT Application No. US2009/038987; International Search Report of the International Searching Authority for Applicant Humanscale Corporation dated Jun. 5, 2009.
The Knoll product manual; pp. 110-119.
PCT Application No. US2005/016550; Written Opinion of the EPO Searching Authority for Applicant Humanscale Corporation dated Mar. 28, 2006.
PCT Application No. US2005/016550; International Preliminary Examination Report of the EPO Searching Authority for Applicant Humanscale Corporation dated Sep. 21, 2006.
EPO Application No. 05747961.0 (Mesh Chair Component)—Examiner's Action dated Apr. 26, 2007.
EPO Application No. 05747961.0 (Mesh Chair Component)—Examiner's Action dated Oct. 5, 2007.
EPO Application No. 05747961.0 (Mesh Chair Component)—Examiner's Action dated May 5, 2008.
CA Application No. 2566429 (Mesh Chair Component)—Examiner's Action dated Apr. 29, 2008.
U.S. Appl. No. 07/898,907 (Office Chair), filed Jun. 15, 1992.
PCT Application No. US2006/023834; Written Opinion of the International Searching Authority for Applicant Humanscale Corporation dated Feb. 15, 2009.
EP 08005519, Search Report of the EPO Searching Authority for Applicant Humanscale Corporation dated Sep. 26, 2008.
PCT Application No. US2009/60680; International Preliminary Report on Patentability for Applicant Humanscale Corporation dated Jan. 11, 2012.

* cited by examiner (reclined)

(upright)

(reclined)

(upright)

(reclined)

(upright)

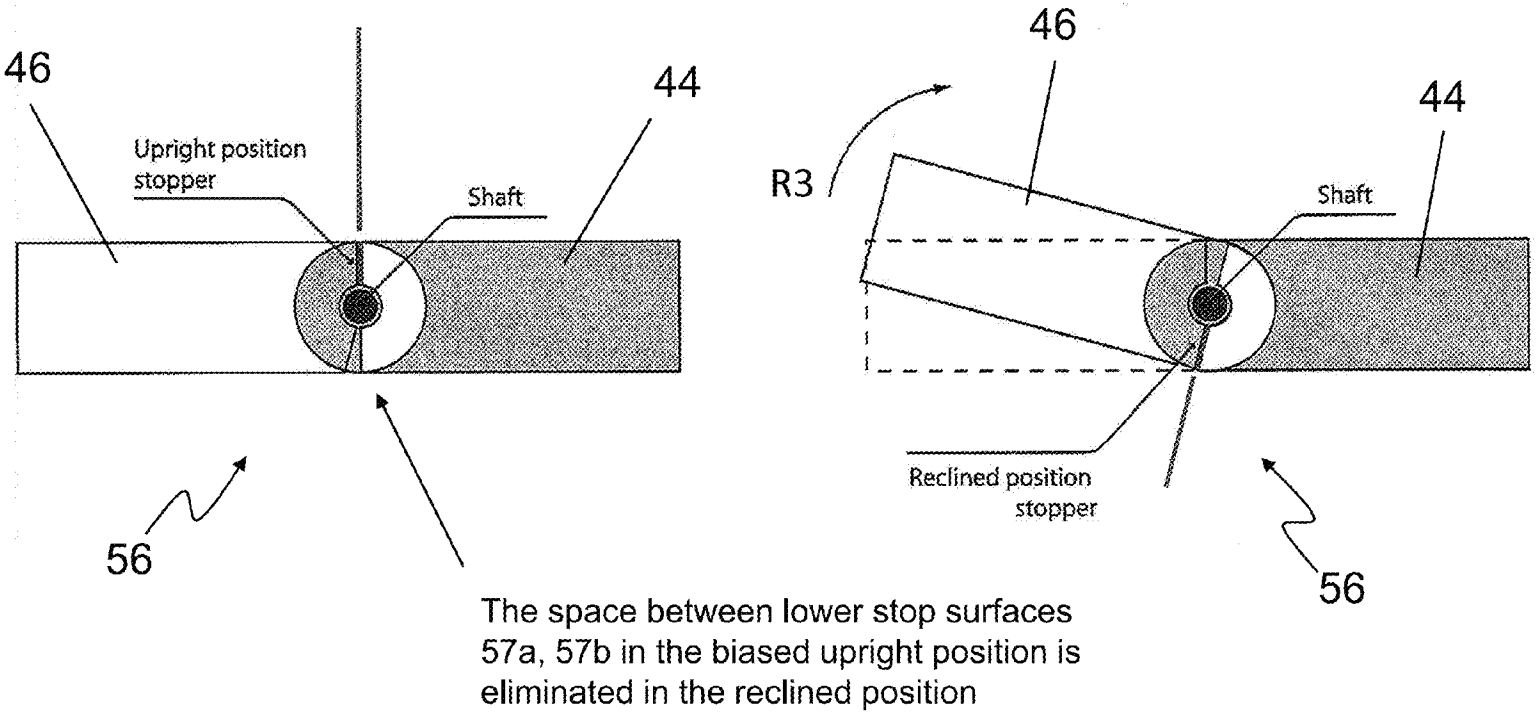
FIG. 11b (reclined)
FIG. 11a (upright)

RECLINING CHAIR

CROSS-REFERENCE TO RELATED APPLICATION

This application claims the benefit of U.S. Provisional Application No. 61/622,358, filed Apr. 10, 2012, and U.S. Provisional Application No. 61/625,373, filed Apr. 17, 2012, both of which are hereby incorporated by reference.

BACKGROUND

In industrialized countries, people spend a significant percentage of their day seated in chairs. A common goal in the field of ergonomic seating, particularly office chairs and the like, is to provide an apparatus that improves the occupant's comfort while maintaining the body in a neutral position. To enhance comfort and provide improved ergonomic function, office and task seating typically feature a high degree of adjustability. For example, it is common for office chairs to provide mechanisms for adjusting the seat, the armrests, and the backrest. Increased adjustability ensures a better fit for the occupant while providing adequate support in a variety of sitting postures.

One key aspect of chair mechanics central to chair comfort is the reclining movement of the backrest. An occupant can experience fatigue from sitting in an upright posture for a prolonged period of time even when an occupant is maintaining a neutral position. Further, some occupants simply may prefer to maintain a reclined posture when seated.

Thus, many chairs incorporate an adjustment mechanism allowing the backrest to recline. However, many of these mechanisms have been less than ideal, very cumbersome or not practicable to an occupant. Instead, rather than confront the processes necessary to adjust their chairs to fit the needs of their particular body build, most occupants of chairs use them without making any adjustments. Consequently, any ergonomic advantages that might be delivered by the properly tuned chair are not achieved. Thus, there remains a need for a chair that is reclinable without requiring any substantial effort on the occupant's part to effect the recline adjustment. Further, there is a need for a low-profile stackable chair with such a recline adjustment.

SUMMARY OF THE INVENTION

The invention disclosed herein is directed to a reclinable chair featuring a weight-sensitive recline mechanism. The reclinable chair can comprise a base a support frame pivotally mounted to the base, and a support surface mounted to the support frame. The support frame can include a seat frame portion disposed between and pivotally connected to both a front frame portion and a back frame portion. The back frame portion of the support frame can also be pivotally attached to a rear end of the base, while the front frame portion can also be pivotally attached to a front end of the base. In this arrangement, the support frame and the base can cooperatively function as a linkage system capable of providing a weight-sensitive recline mechanism in a low-profile, stackable chair.

The reclinable chair of the present invention can also feature a support surface having a pattern of holes formed through the support surface in such a way that the areas having greater flexibility actually have smaller openings and more surrounding material and the areas having less flexibility have larger openings and less surrounding material. In particular, the present invention utilizes a pattern of openings shaped by a plurality of higher pitch curvilinear segments (and thus more material) to provide greater flexibility and a pattern of openings shaped by a plurality of lower pitch, straighter segments (and thus less material) to provide less flexibility. The support surface is preferably constructed out of flexible material and can comprise a backrest portion and a seat portion. The backrest portion and the seat portion can be integrally formed as a one-piece flexible support surface, or the backrest and seat portions can be separate pieces attached to each other.

The above summary is not intended to describe each illustrated embodiment or every possible implementation. These and other features, aspects, and advantages of the present invention will become better understood with regard to the following description, appended claims, and accompanying drawings.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which:

FIGS. 11*a* to 11*b* are diagrammatic views of an exemplary hinge of the support frame of FIG. 10, shown in an upright position and a reclined position;

DETAILED DESCRIPTION OF THE INVENTION

Figure 1:
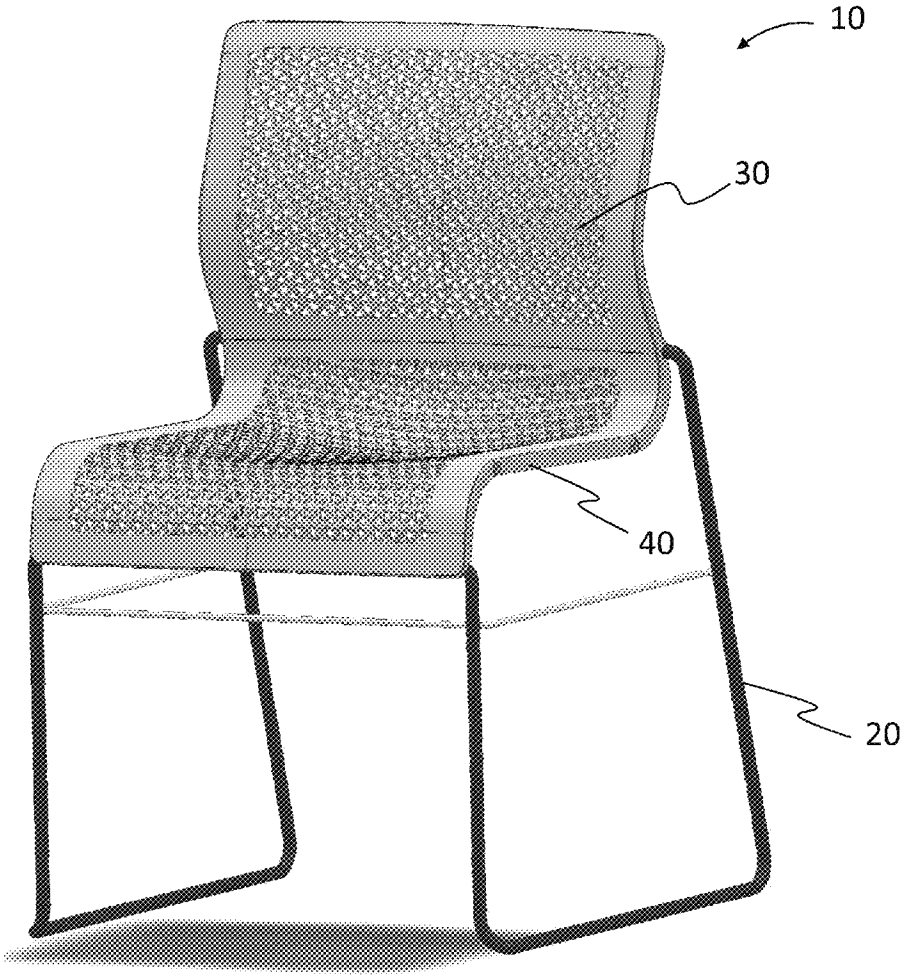
FIG. 1 is a front perspective view of an embodiment of a reclinable chair exemplifying the principles of the present invention.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

The present invention is a chair, which provides improved comfort and support while maintaining simplicity in its design. A stackable chair embodiment of the invention is particularly useful when the chairs are for temporary use.

Figure 2:
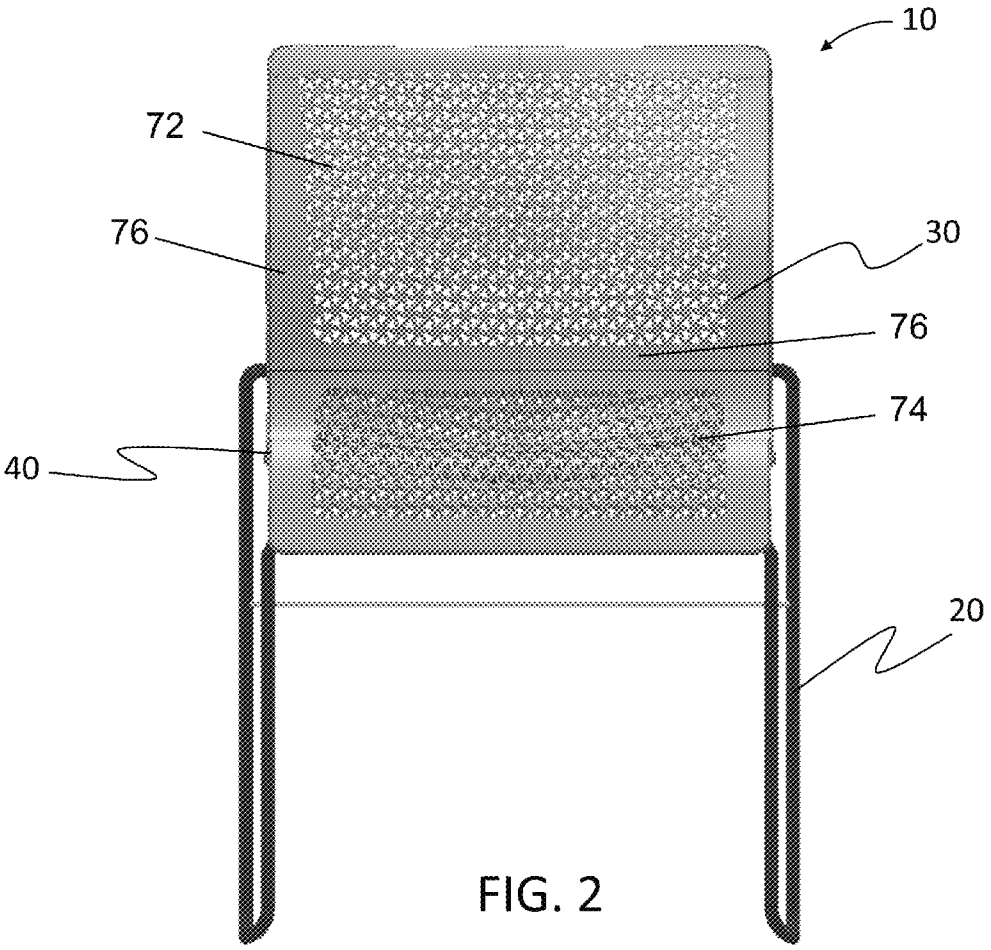
FIG. 2 is a front view of the chair of FIG. 1.
Figure 3:
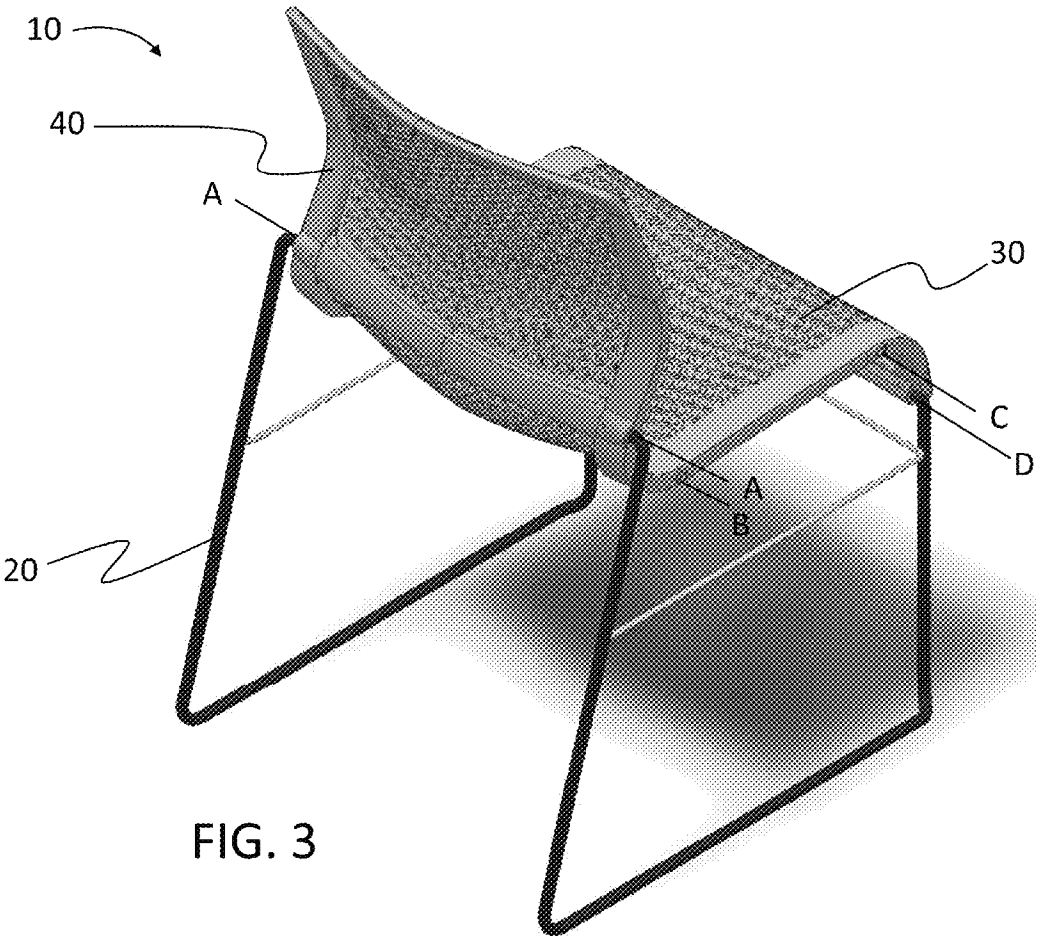
FIG. 3 is a rear perspective view of the chair of FIG. 1.
Figure 4:
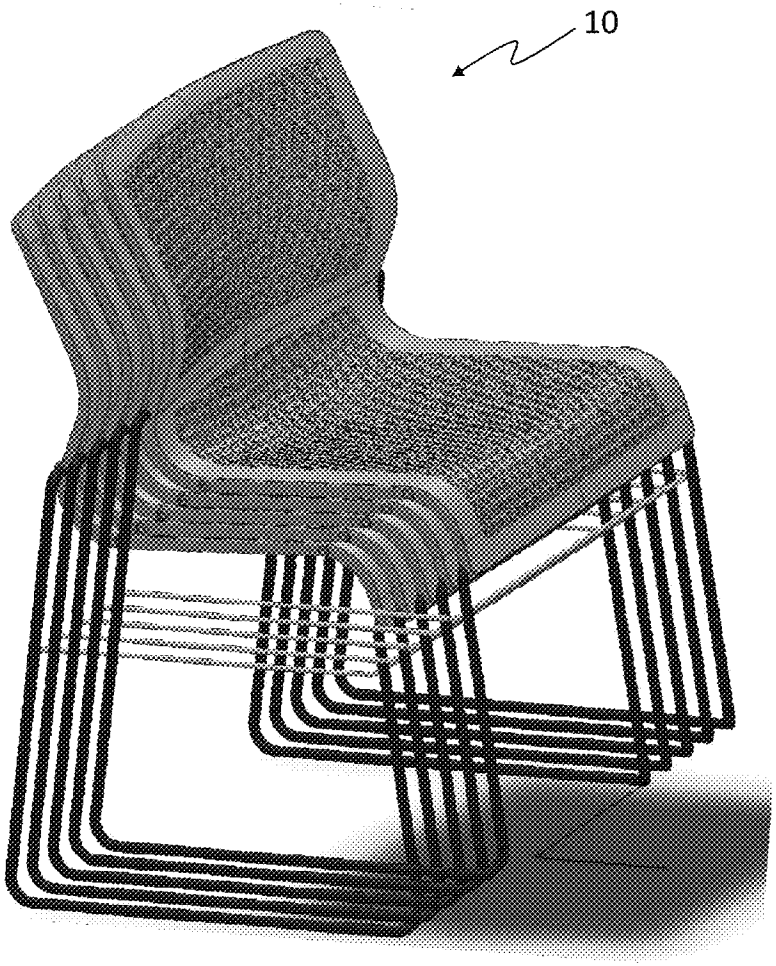
FIG. 4 is side perspective view of a plurality of stacked reclinable chairs exemplifying the principles of the present invention.
Figure 5:
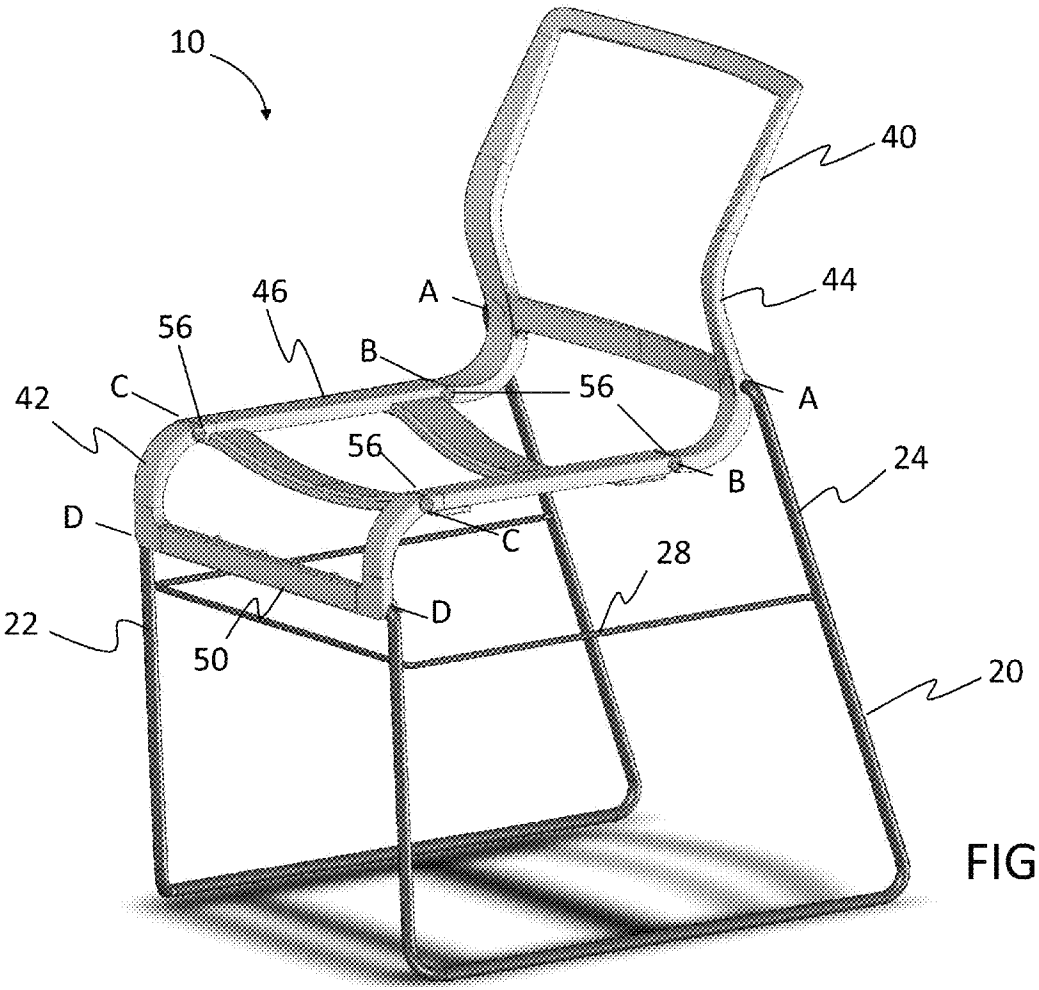
FIG. 5 is a side perspective view of the chair of FIG. 1, shown without a flexible support surface.

Referring to FIGS. 1 to 3, a chair 10 embodying the principles of the invention includes a flexible support surface 30 supported by a support frame 40 on a chair base 20. In this exemplary embodiment, the chair 10 is a stacking chair with a sled base 20 in the form of cylindrical tubing, preferably constructed out of metallic or semi-metallic material such as steel and aluminum. In an exemplary embodiment, the support frame 40 includes three or more component frames, at least two of which secure the support frame 40 to the base 20. As depicted in FIG. 5, an exemplary support frame 40 includes a front frame portion 42 pivotally attached to the front end 22 of the base 20; a back frame portion 44 pivotally attached to the rear end 24 of the base 20; and a seat frame portion 46 disposed between and pivotally connected to both the front and back frame portions 42, 44. The component frames 42, 44, 46 and the base 20 cooperatively function as a linkage system to provide a weight-sensitive recline mechanism and a low-profile, high-stacking chair 10. FIG. 4 depicts a plurality of stacked chairs 10, wherein, due to the small footprint of the recline mechanism, there is very little distance between adjacent chairs 10. Thus, the chairs 10 can be stacked high during storage.

Figure 6A:
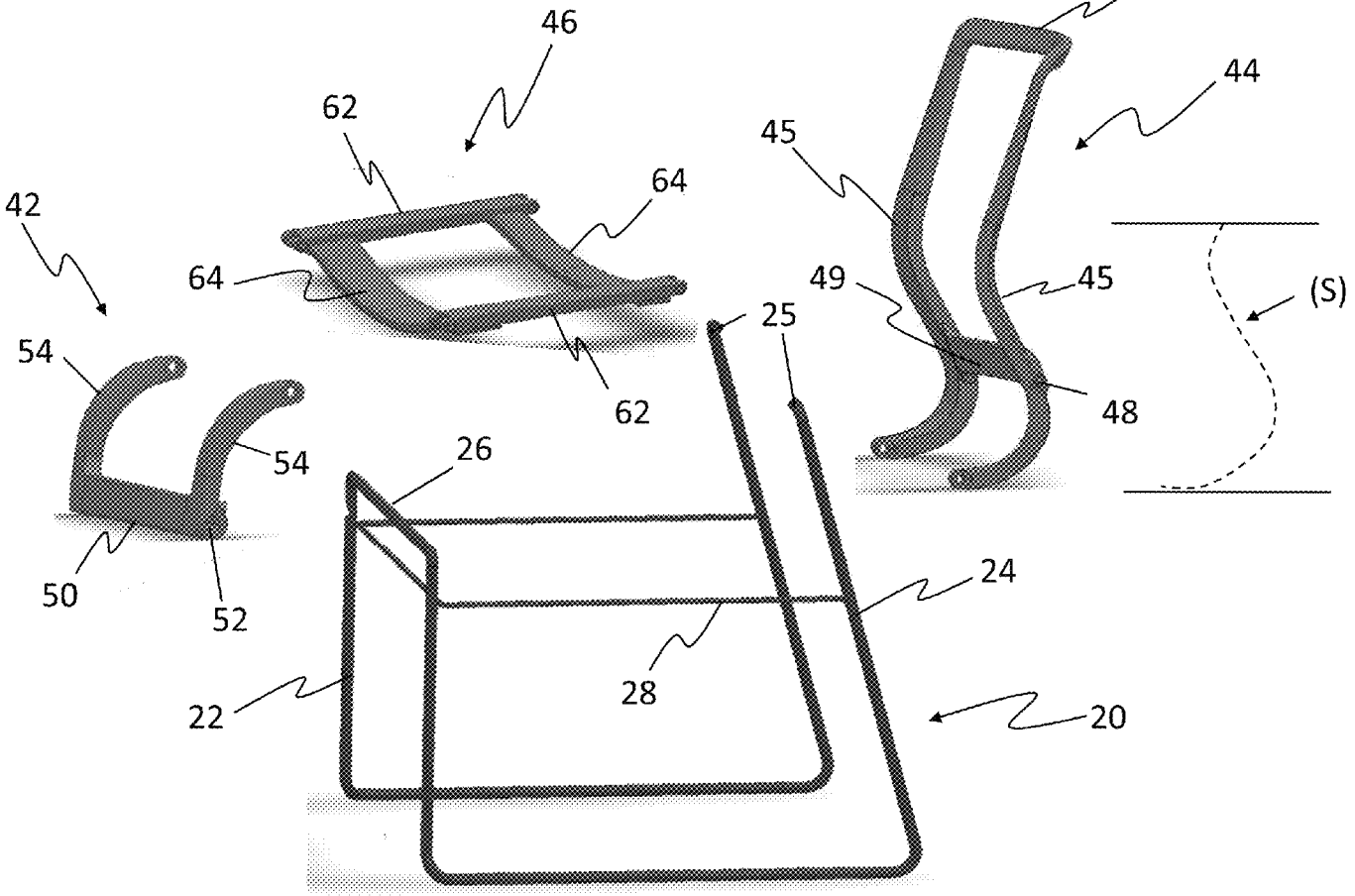
FIG. 6*a* is an exploded view of the chair of FIG. 5.
Figure 6B:
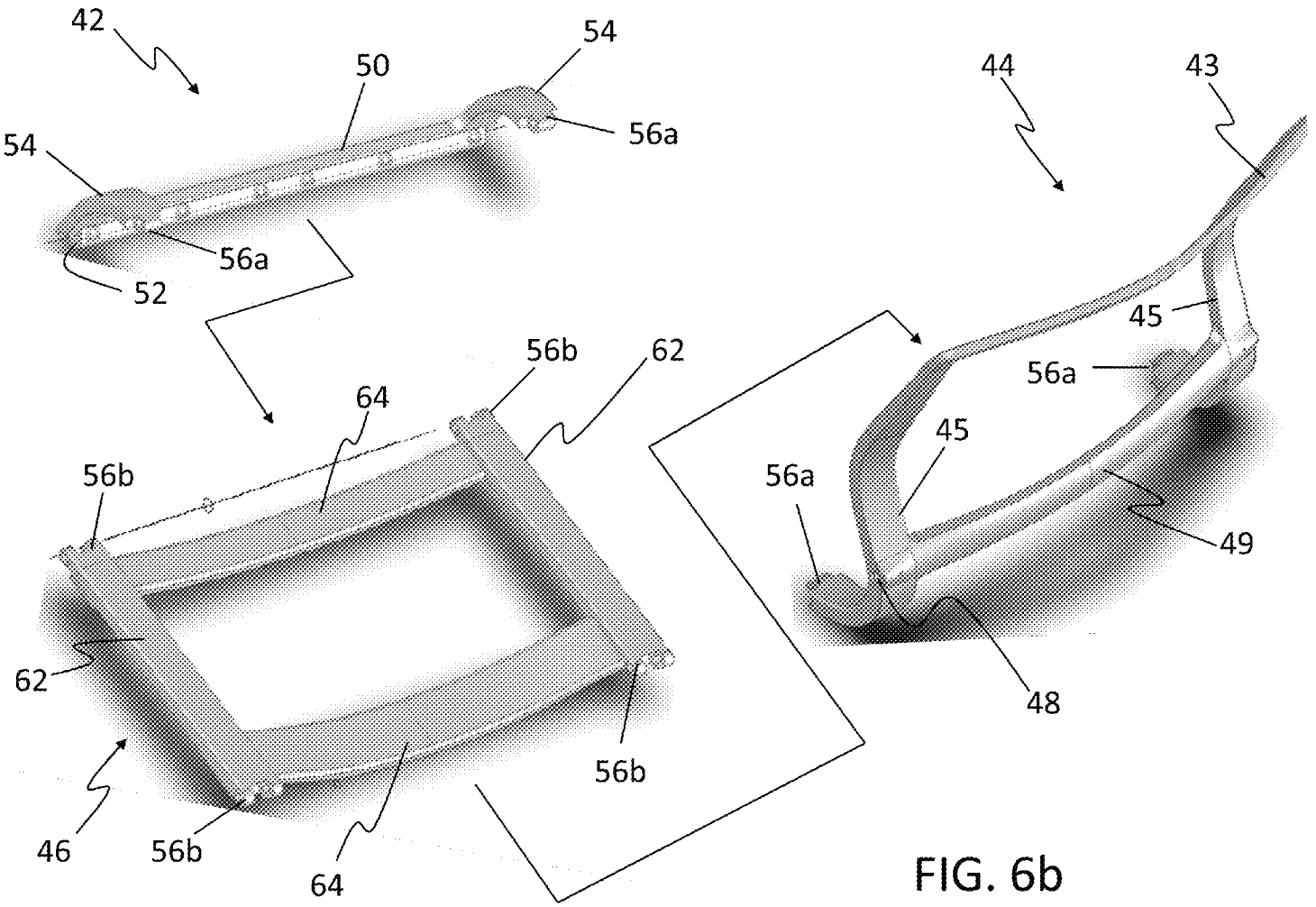
FIG. 6*b* is an exploded, top perspective view of the support frame of the chair of FIG. 5.
Figure 7B:
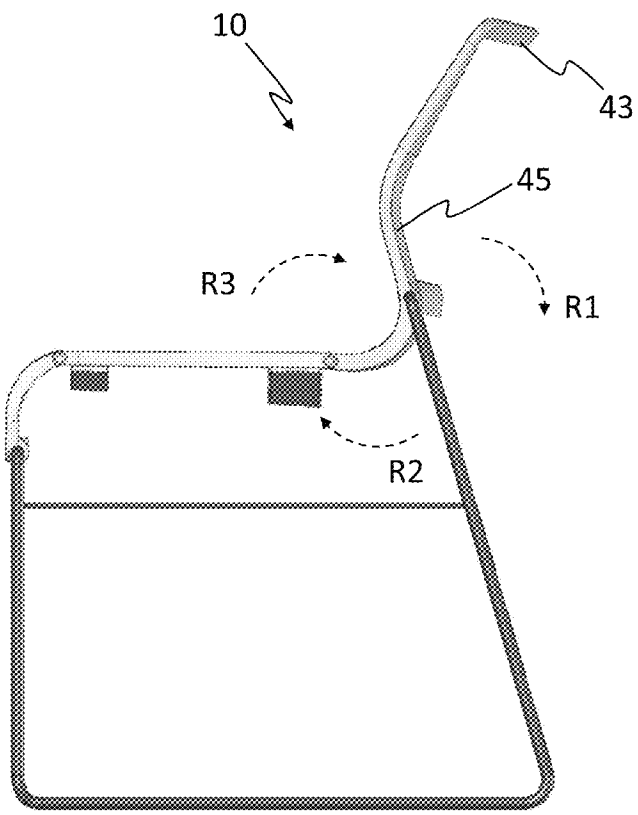
FIGS. 7*a* to 7*b* are side views of the chair of FIG. 5, shown in an upright position and a reclined position.
Figure 7A:
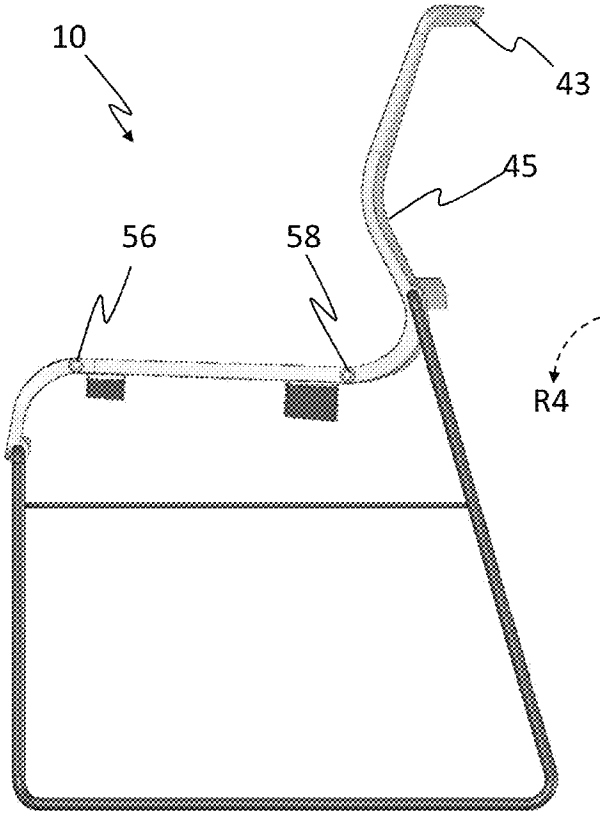
Figure 8B:
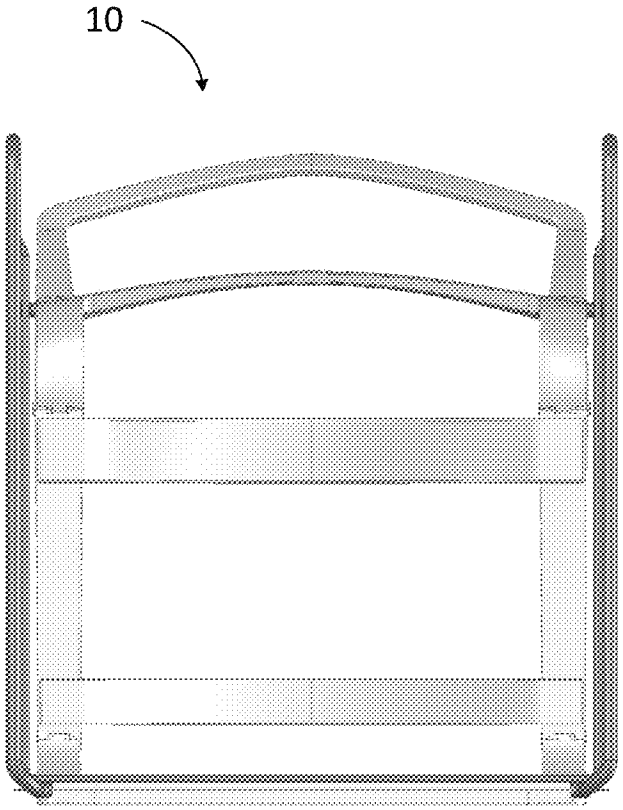
FIGS. 8*a* to 8*b* are bottom views of the chair of FIG. 5, shown in an upright position and a reclined position.
Figure 8A:
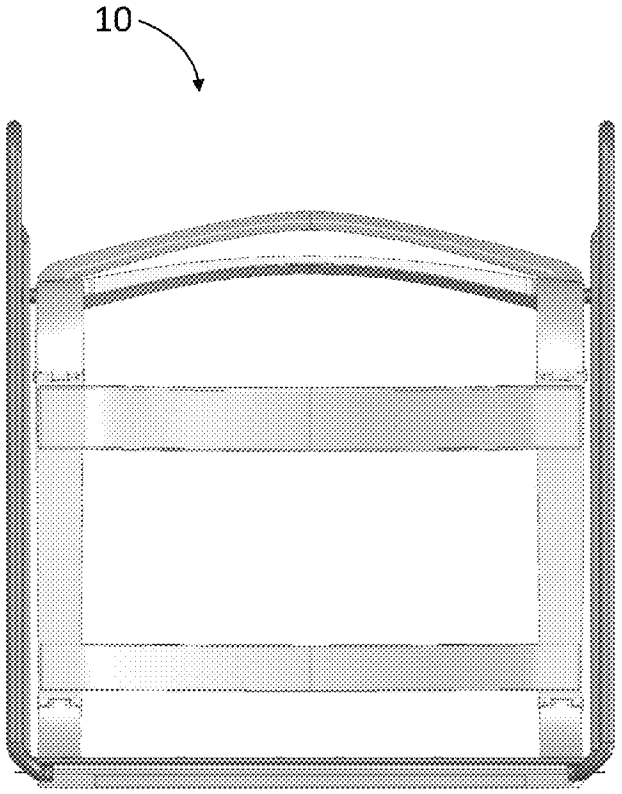
Figure 9B:
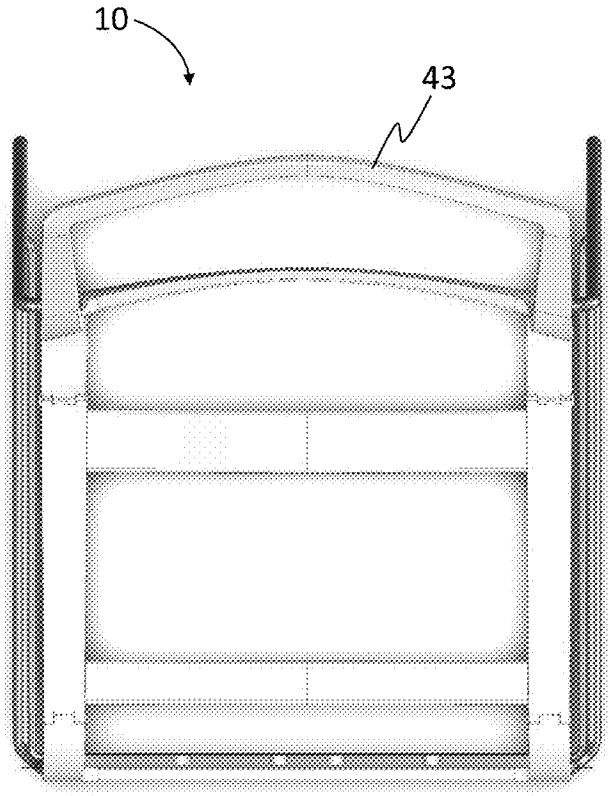
FIGS. 9*a* to 9*b* are top views of the chair of FIG. 5, shown in an upright position and a reclined position.
Figure 9A:
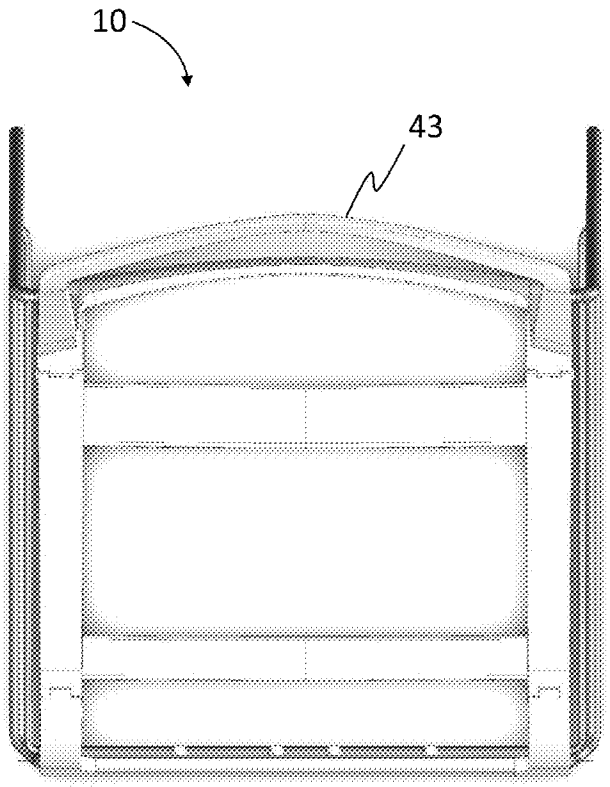

As shown in FIG. 5, the recline mechanism includes a linkage system having four pivot axes A, B, C, and D about which the support frame 40 pivots to move the chair 10 between an upright position (FIGS. 7*a*, 8*a*, 9*a*) and a reclined position (FIGS. 7*b*, 8*b*, 9*b*). The back frame portion 44 is pivotally secured to the base rear end 24 about a first pivot axis A. In an exemplary embodiment, the back frame portion 44 is a contoured frame including a top edge 43 having a concave shape when viewed from the top (FIGS. 9*a* and 9*b*) and opposing side edges 45 extending therefrom and shaped to support the lumbar region of an occupant's back in both upright and reclined positions. When viewed from the side (FIGS. 7*a* and 7*b*), the side edges 45 have a soft S-shaped curve (S) (see FIG. 6*a*) extending between about the middle section of the side edge 45 and the lower ends of the side edges 45. As shown in FIGS. 6*a* and 6*b*, the side edges 45 include opposing apertures 48 at about the middle section of the (S) curve, at approximately the start of the bottom curve of the (S) curve. The opposing apertures 48 are shaped to receive and rotate about opposing ends 25 of the base rear end 24, the pivot axis A thus extending through the opposing apertures 48. The opposing ends 25 of the base 20 are securely retained within the apertures 48 by any suitable means known in the art. As further illustrated in FIGS. 6*a* and 6*b*, the back frame portion 44 includes a slightly concave curved support bar 49 extending between the opposing apertures 48 to provide additional support for the occupant.

Referring back to FIG. 5, the front frame portion 42 of the support frame 40 is pivotally secured to the base front end 22 about a second pivot axis D. As depicted in FIGS. 6*a* and 6*b*, an exemplary front frame portion 42 includes a horizontal bottom edge 50 defining an aperture 52 shaped to receive and rotate about a horizontal cross-bar 26 at the front end 22 of the base 20, the pivot axis D thus extending through the aperture 52 and the horizontal cross-bar 26. The front frame portion 42 can be pivotally secured to the base front end 22 by any suitable means known or contemplated by one of ordinary skill in the art. For example, the base 20 can be assembled in separate pieces, the horizontal cross-bar 26 being received within a predefined aperture 52 of the front frame portion 42 prior to being assembled to the remaining base portions. Alternatively, two opposing sections of the front frame portion 42 can be attached together about the horizontal crossbar 26 of a preassembled base 20 to form the aperture 52, for example, through welding or any other suitable attachment means known in the art. As shown in FIGS. 6*a* and 6*b*, the front frame portion 42 has two opposing side edges 54 that curve upward and away from the bottom edge 50.

In an exemplary embodiment, the front frame portion 42 is connected to the back frame portion 44 by at least one connecting frame portion about at least two additional pivot axes. As shown in FIG. 5, the support frame 40 includes a seat frame portion 46 disposed between the front and back frame portions 42, 44. Referring to FIGS. 6*a* and 6*b*, an exemplary seat frame portion 46 includes two side edges 62 and two slightly concave curved support bars 64 extending therebetween to provide additional support to the flexible support surface 30 and the occupant. The seat frame portion 46 is connected to the back frame portion 44 through a first pair of opposing hinges 56, thus defining a third pivot axis B, and to the front frame portion 42 through a second pair of opposing hinges 56, thus defining a fourth pivot axis C. As best illustrated in FIG. 6*b*, the opposing side edges 45 of the back frame portion 44 include first hinge sub-parts 56*a* at the lower ends of the (S) curve configured to mate with the corresponding second hinge sub-parts 56*b* at the rear end of the side edges 62 of seat frame portion 46. Similarly, the opposing side edges 54 of the front frame portion 42 include first hinge sub-parts 56*a* configured to mate with the corresponding second hinge sub-parts 56*b* at the front end of the side edges 62 of the seat frame portion 46. It is also within the scope of the present invention for the first hinge sub-parts 56*a* on the front and back frame portions 42, 44 to be second hinge sub-parts 56*b* and for the second hinge sub-parts 56*b* on the seat frame portion 46 to be first hinge sub-parts 56*a*.

Figure 10:
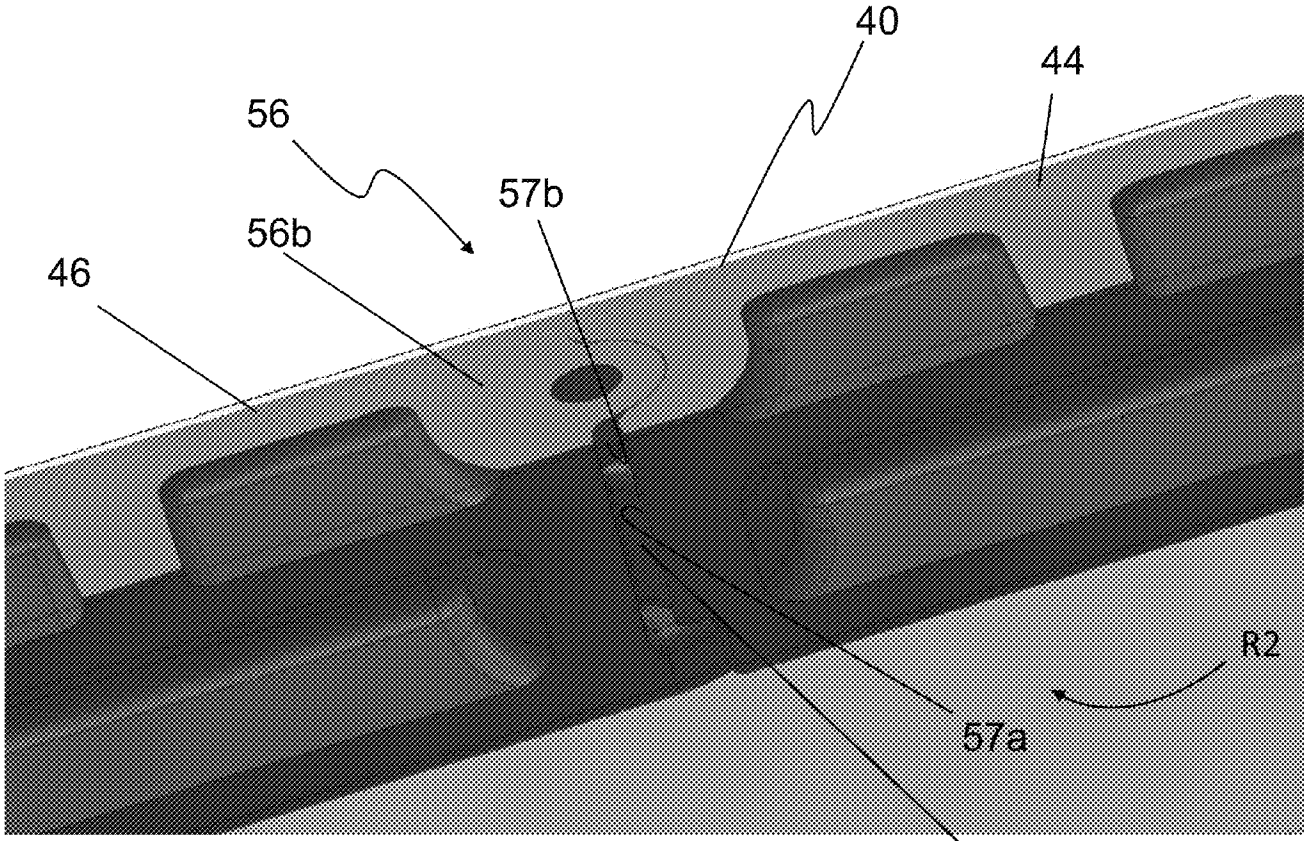
FIG. 10 is a partial, bottom perspective view of a support frame of a chair embodying the principles of the present invention.

FIG. 10 shows a bottom perspective view of a rear hinge 56 joining the rear end of the seat frame portion 46 and the back frame portion 44, shown in the biased upright position, wherein a space exists between lower stop surfaces 57*a*, 57*b* of respective hinge sub-parts 56*a*, 56*b*. As desired, the occupant may use his or her weight to push against the back frame portion 44 to recline the chair 10 into the reclined position. As force is applied to the back frame portion 44, the back frame portion 44 pivots about axis A, wherein the top portion of the back frame portion 44 pivots in the direction of arrow R1 (FIG. 7*b*) and the bottom portion of back frame portion 44 pivots in the direction of arrow R2 (FIGS. 7*b* and 10). In the reclined position, the lower stop surfaces 57*a* of the hinge sub-parts 56*a* abut the lower stop surfaces 57*b* of hinge sub-parts 56*b* of the rear hinges 56, thus eliminating the space (shown in FIGS. 10 and 11*a*) between the lower stop surfaces 57*a*, 57*b* of the rear hinges 56. This movement causes the seat frame portion 46 to pivot about axis B, in the direction of arrow R3, as shown in FIG. 11*b*. Axis B runs through the longitudinal axis of the shaft of the rear hinge 56. Although the recline mechanism of the present invention lifts the occupant slightly, the recline movement of the seat frame portion 46 in FIG. 11*b* is exaggerated for illustration purposes. The front hinges 56 connecting the front end of the seat frame portion 46 and the front frame portion 42 are configured such that recline movement transferred through the seat frame portion 46 causes the front hinges 56 to pivot about axis C, pivoting the front frame portion 42 forward about axis D in the direction of arrow R4 (FIG. 7*b*).

In an exemplary embodiment, the base 20 includes a crossbar 28 extending along the front and sides thereof to prevent the base 20 from moving as the chair 10 reclines. The crossbar 28 can be a one-piece crossbar 28, integrally formed with two bends, extending from a first side of the rear end 24 to a first side of the front end 22, across to a second side of the front end 22, and back toward a second side of the rear end 24. Alternatively, the base 20 can include three individual and separately attached crossbars 28. The crossbar 28 can be attached to the base 20 by any suitable means in the art that would maintain the base 20 in a static position as the occupant reclines in the chair 10.

Figure 16:
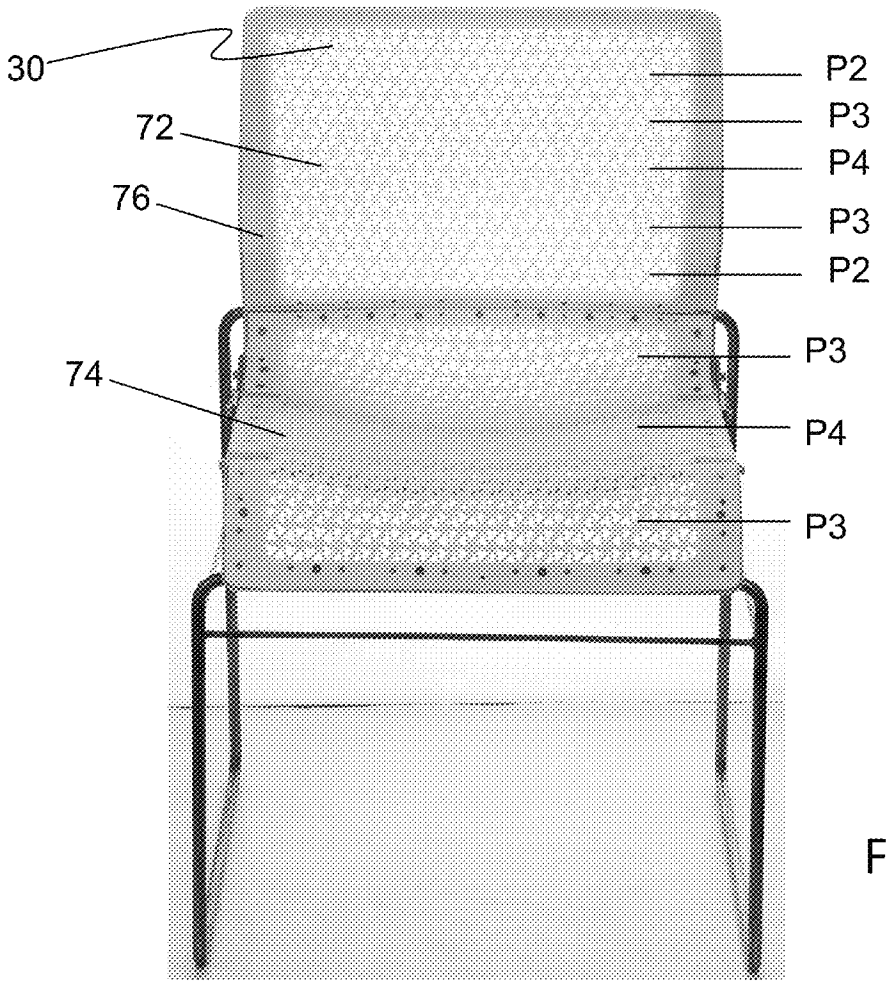
FIG. 16 is a photograph of a prototype of a reclinable chair exemplifying the principles of the present invention.

Referring to FIGS. 2 and 16, an exemplary flexible support surface 30 includes a backrest portion 72 and a seat portion 74, each formed with a pattern of holes or openings, and a solid border 76 (no openings formed therethrough) surrounding each of the backrest and seat portions 72, 74. The backrest and seat portions 72, 74 are thus separated by the solid border 76. The backrest and seat portions 72, 74 may be integrally formed as a one-piece flexible support surface 30 (FIG. 2) or they may be comprised of separate pieces attached to each other and/or the support frame 40 (FIG. 16).

Chairs having a pattern of openings of varying shapes and/or sizes formed through a flexible support surface, e.g., a polymeric or elastomeric support surface, to create zones of differing flexibility are known in the art. These chairs have been configured based upon the principle that larger holes/less material provide areas of greater flexibility and smaller holes/more material provide areas of less flexibility. Thus, it has been common practice in the art to form larger holes in the areas of the flexible support surface in which greater flexibility is desired and smaller holes in the areas in which less flexibility is desired.

Contrary to the teachings of the prior art, an exemplary flexible support surface 30 embodying the principles of the present invention includes a pattern of holes formed through the flexible support surface 30 in such a way that the areas having greater flexibility actually have smaller openings and more surrounding material and the areas having less flexibility have larger openings and less surrounding material.

Figure 12A:
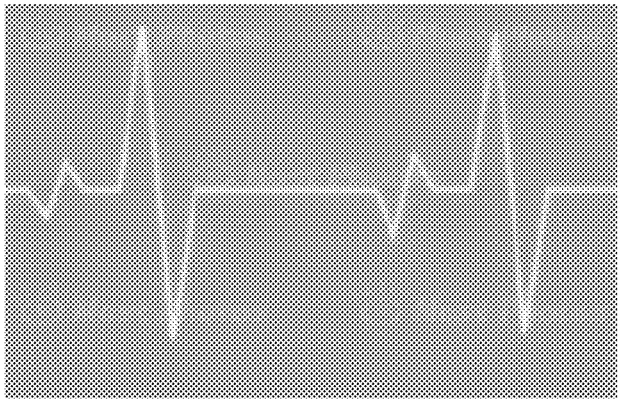
FIGS. 12*a* to 12*c* are diagrams used in the development of an exemplary flexible support surface pattern.
Figure 12B:
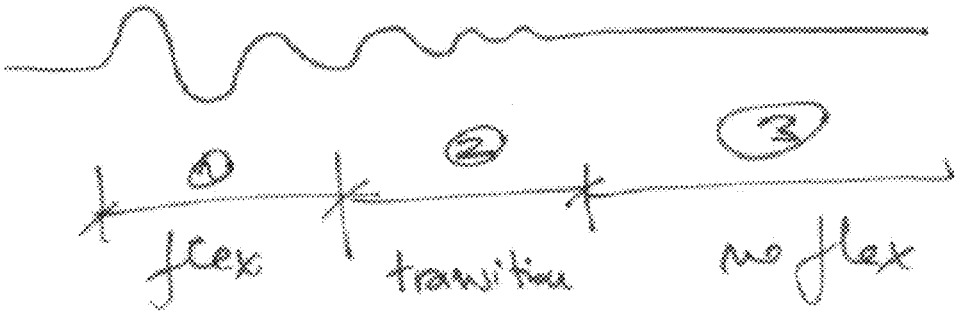
Figure 12C:
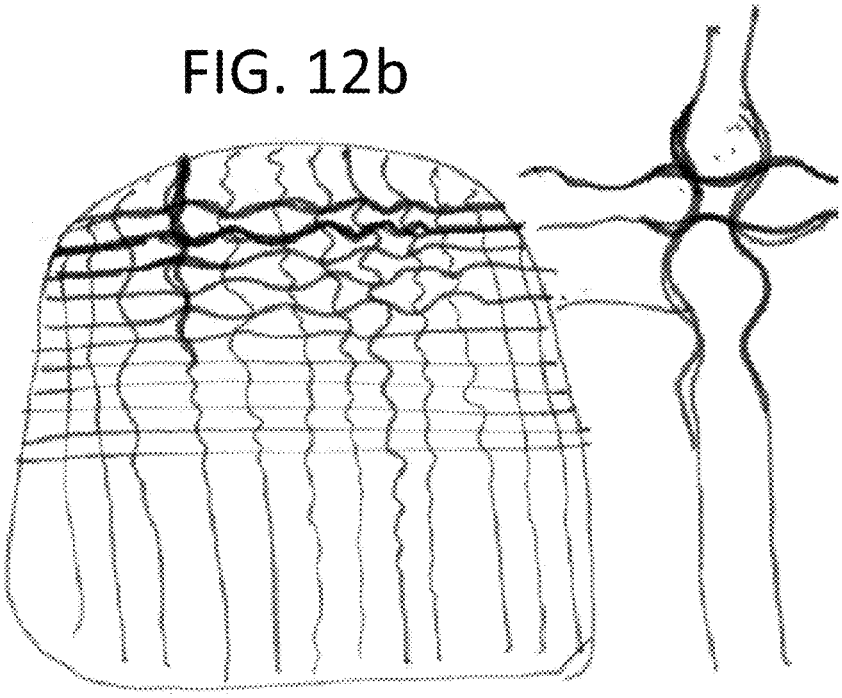
Figure 13:
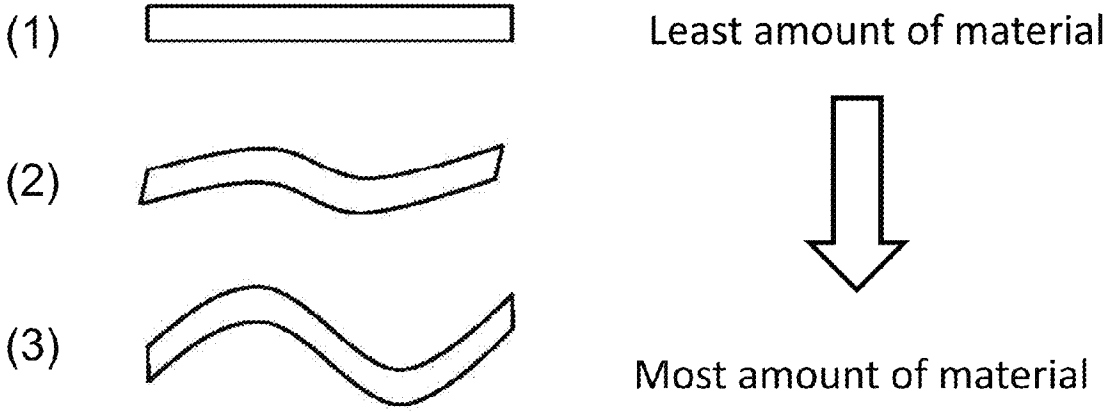
FIG. 13 is a diagram illustrating a common geometric principle known in the art.

FIGS. 12*a* to 12*c* and FIG. 13 include diagrams outlining the thought-process behind the development of an exemplary flexible support surface pattern 30. An ideal way to transmit force throughout the flexible support surface 30 is to keep the same number of connectors throughout the pattern. Building upon the analogy force distribution equals frequency, it was thought to alter the two variables of the pattern design (pitch and stop) and create something that looks like a derivative of a frequency monitor (FIG. 12*a*), i.e., a softer version of a frequency line (FIG. 12*b*). Nature always responds to changes with variable frequencies—an exemplary pattern would replicate that. Following this logic, referring to FIG. 12*b*, higher pitch curvature (and step) would result in greater flexibility and straighter lines (i.e., lower pitch curvature or no pitch) would result in lower flexibility or none at all. Referring to FIG. 13, a pattern of shapes defined by straighter lines equates to less material, whereas a pattern of shapes defined by higher pitch curvature lines equates to more material. Thus, a flexible support surface having a pattern of openings shaped by a plurality of segments similar to the curvilinear segment (3) of FIG. 13 would be comprised of more material than a pattern of openings shaped by the same number of segments, but similar to the straight segment (1) of FIG. 13.

The present invention utilizes a pattern of openings shaped by a plurality of higher pitch curvilinear segments (and thus more material) to provide greater flexibility and a pattern of openings shaped by a plurality of lower pitch, straighter segments (and thus less material) to provide less flexibility. This is in complete contradiction to the commonly accepted principle that less material means greater flexibility and more material means less flexibility, a principle that has been implemented in the design of flexible support surfaces of chairs currently on the market.

Figure 14:
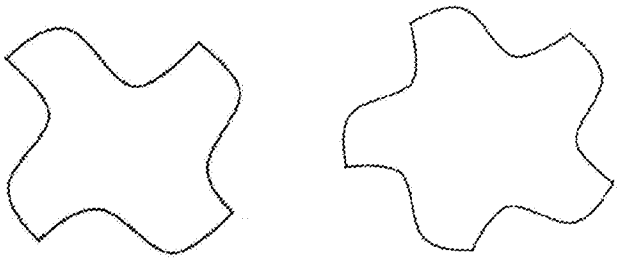
FIG. 14 depicts alternative shapes for exemplary flexible support surface patterns.

Although the general shape used throughout the exemplary pattern described above includes three sides or segments, shapes comprised of four or more sides or segments may be used to alter the ornamental appearance of the flexible surface support 30 without falling beyond the scope of the invention. FIG. 14 illustrates two exemplary alternative shapes that may be used to define a pattern of openings, of course with varying pitch and step, i.e., the segments defining the shape are straighter in areas of less flexibility and curvier in areas of greater flexibility.

Figure 15B:
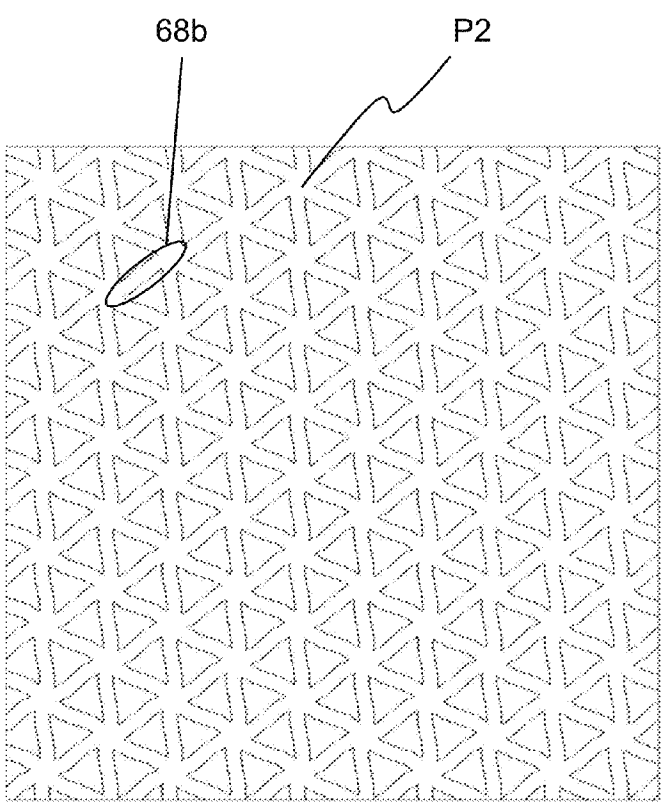
FIGS. 15*a* to 15*d* are top views of various flexible support surface patterns tested for use in a reclinable chair exemplifying the principles of the present invention.
Figure 15A:
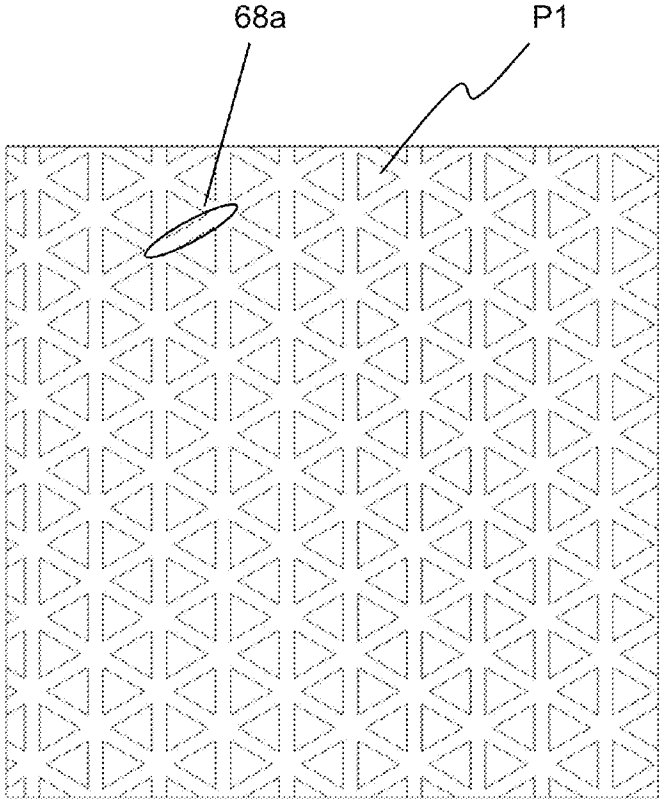
Figure 15D:
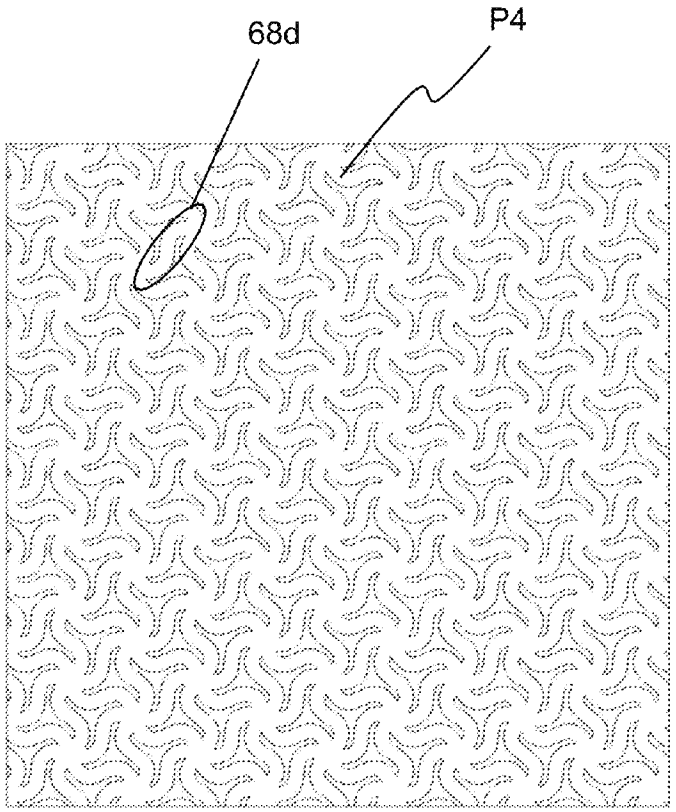
Figure 15C:
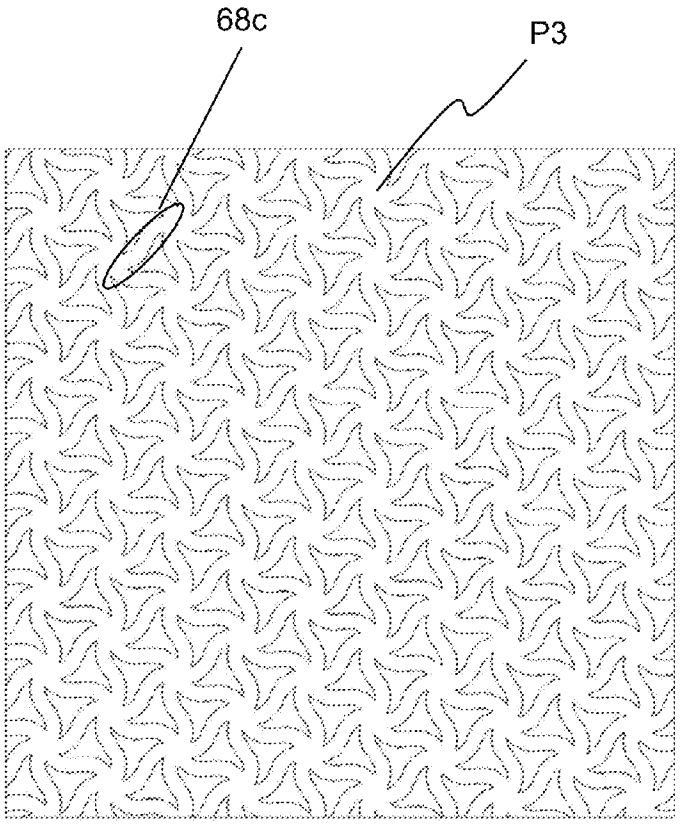

FIGS. 15*a* to 15*d* illustrate different pattern variations that were tested for flexibility. The pattern P1 of FIG. 15*a* is defined by a plurality of openings shaped by lines or segments 68*a*; the pattern P2 of FIG. 15*b* is defined by a plurality of openings shaped by lines or segments 68*b*; the pattern P3 of FIG. 15*c* is defined by a plurality of openings shaped by lines or segments 68*c*; and the pattern P4 of FIG. 15*d* is defined by a plurality of openings shaped by lines or segments 68*d*. Segments 68*a* are substantially straight; segments 68*b* have a higher pitch curvature than segments 68*a*; segments 68*c* have a higher pitch curvature than segments 68*b*; and segments 68*d* have the highest pitch curvature of all segments 68*a*, 68*b*, 68*c*, 68*d*. Flexibility tests performed on each of the four patterns P1 to P4 revealed that flexibility increased as the pitch curvature of the segments defining the opening shape increased, pattern P1 thus having the least amount of flexibility and pattern P4 having the greatest flexibility of the four tested patterns. Accordingly, an exemplary flexible surface support 30 includes variations of the patterns P1 to P4 as desired flexibility dictates.

FIG. 16 illustrates an exemplary flexible support surface 30 having variations in patterns P2 to P4. The flexible support surface 30 includes a less flexible pattern P2 at the top of the backrest portion 72 and transitions to a more flexible pattern toward the middle of the backrest portion 72, first pattern P3 and then pattern P4. Toward the bottom of the backrest portion 72, the pattern transitions back to the pattern P3 and then the less flexible pattern P2 at the bottom of the backrest portion 72. In one embodiment, the flexible support surface 30 includes a more flexible pattern P3 at the rear and front of the seat portion 74 and an even more flexible pattern P4 around the middle of the seat portion 74. The pattern variation depicted in FIG. 16 is merely exemplary. There can be even more variation in the patterns, for example, in addition to that transition from the top to the bottom of the backrest portion 72 and from the rear to the front of the seat portion 74, the patterns may vary from side to side across the backrest and seat portions 72, 74.

An exemplary flexible support surface 30 may be formed from any suitable flexible material known or contemplated in the art including but not limited to elastomeric materials such as Hytrel®, manufactured by DuPont. The flexible support surface 30 can be formed from any suitable method known in the art, including but not limited to common molding methods such as injection molding.

Figure 17:
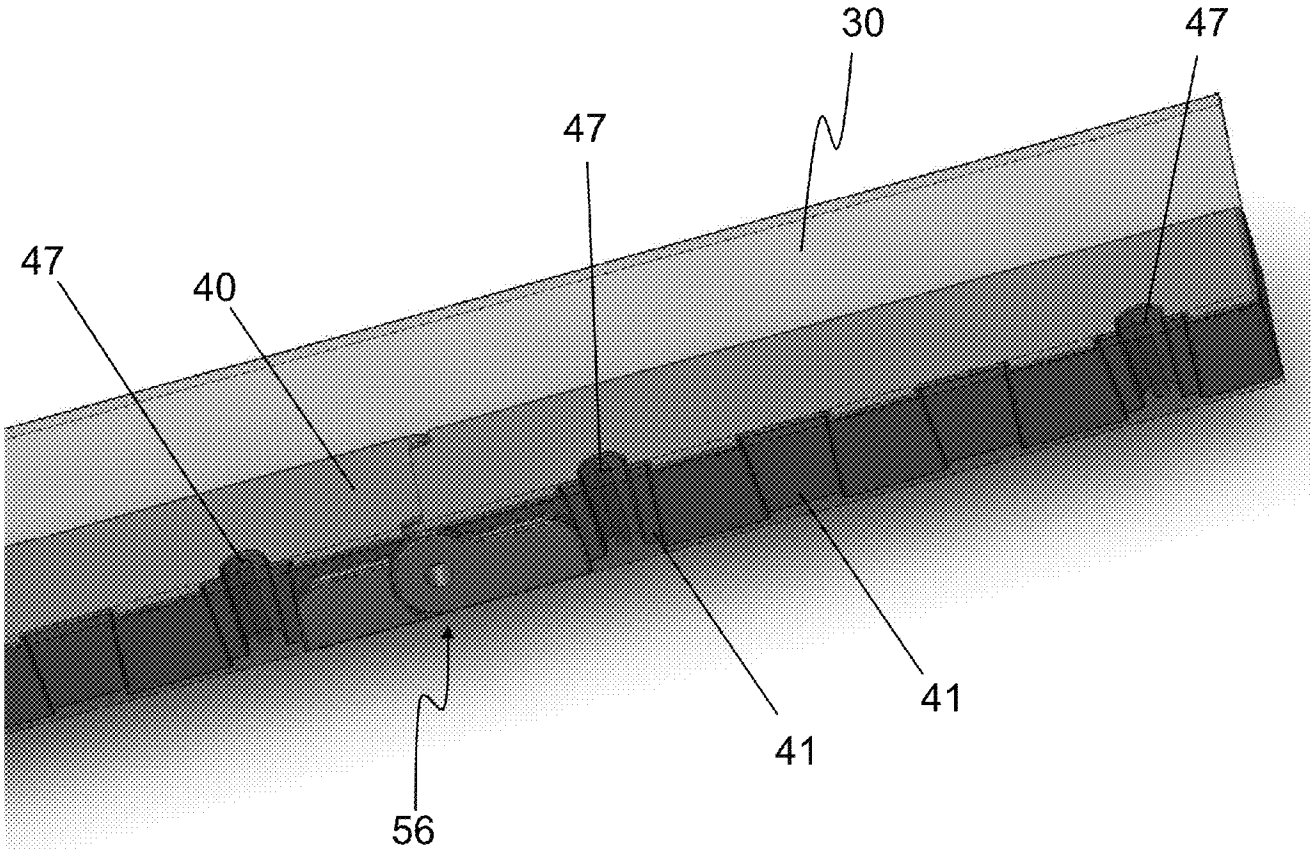
FIG. 17 is a partial top perspective view of a flexible support surface attached to a support frame of a chair embodying the principles of the present invention.

An exemplary method of attaching a flexible support surface 30 to the support frame 40 is illustrated in FIG. 17. In an exemplary embodiment, the support frame 40 has a series of slots or recesses 41 formed in the outer edge surfaces, the recesses 41 being operable to receive the flexible support surface 30 therein. In this embodiment, the flexible support surface 30 is shaped along its edges to form a geometric fit within the recesses 41 of the support frame 40. As shown in FIG. 17, some of the recesses 41 are shaped to receive a screw 47 or the like therethrough to further secure the flexible support surface 30 to the support frame 40.

Figure 18:
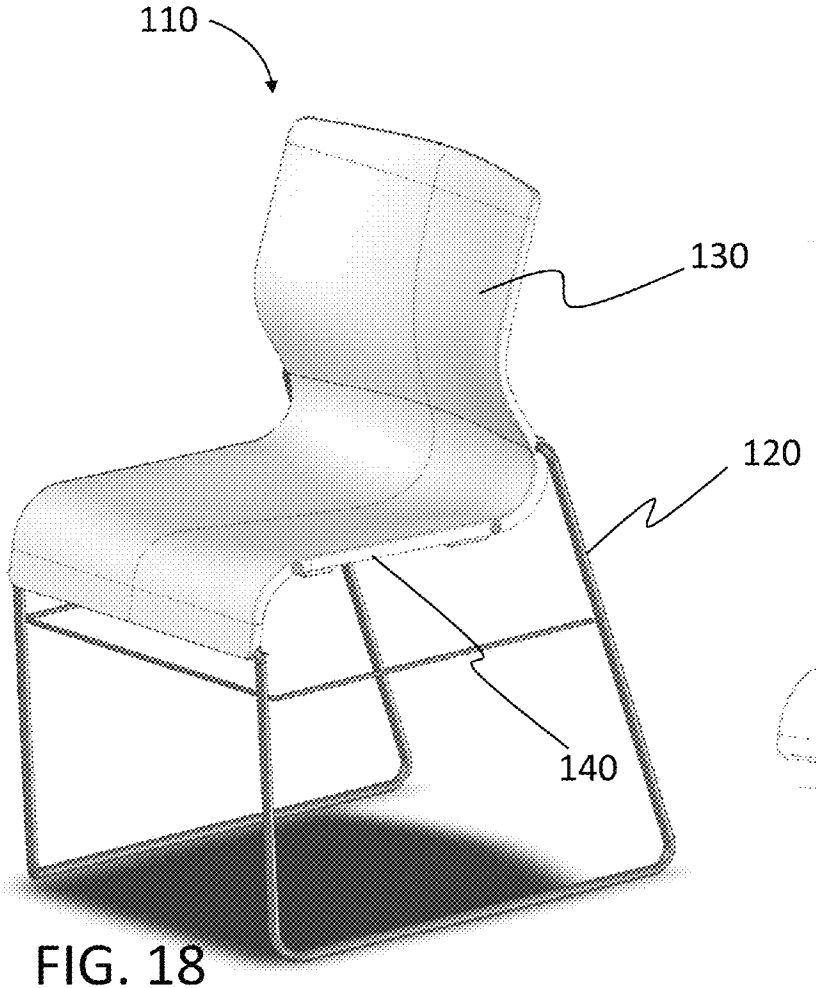
FIG. 18 is a side perspective view of another reclinable chair exemplifying the principles of the present invention.

FIG. 18 illustrates another chair 110 embodying the principles of the present invention, wherein parts common with the chair 10 are denoted by like reference numerals increased by 100. In this embodiment, the flexible support surface 130 does not include a pattern of holes formed therethrough.

Figure 19:
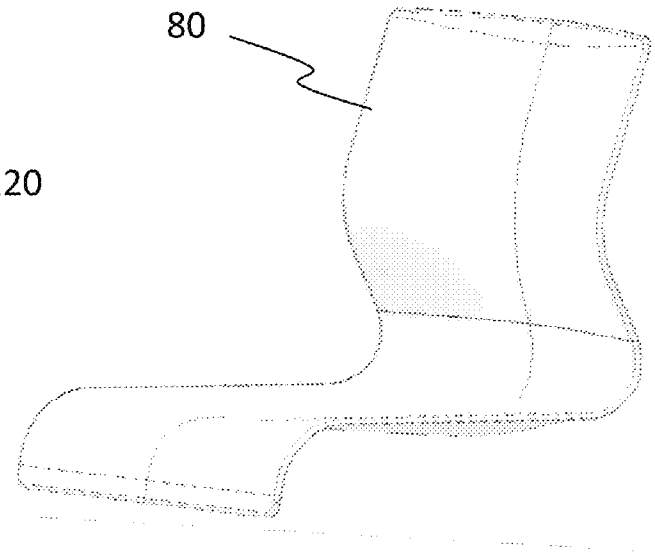
FIG. 19 is a side perspective view of a cushion for use with a reclinable chair exemplifying the principles of the present invention.

FIG. 19 illustrates a cushion 80 attachable to any of the chair embodiments disclosed herein through any suitable means known in the art (e.g., snap closures, adhesives, ties, and the like) to provide added comfort to the occupant. The cushion 80 can be comprised of any suitable material used in chair cushions, e.g., foam, Technogel®, and the like.

Figure 20B:
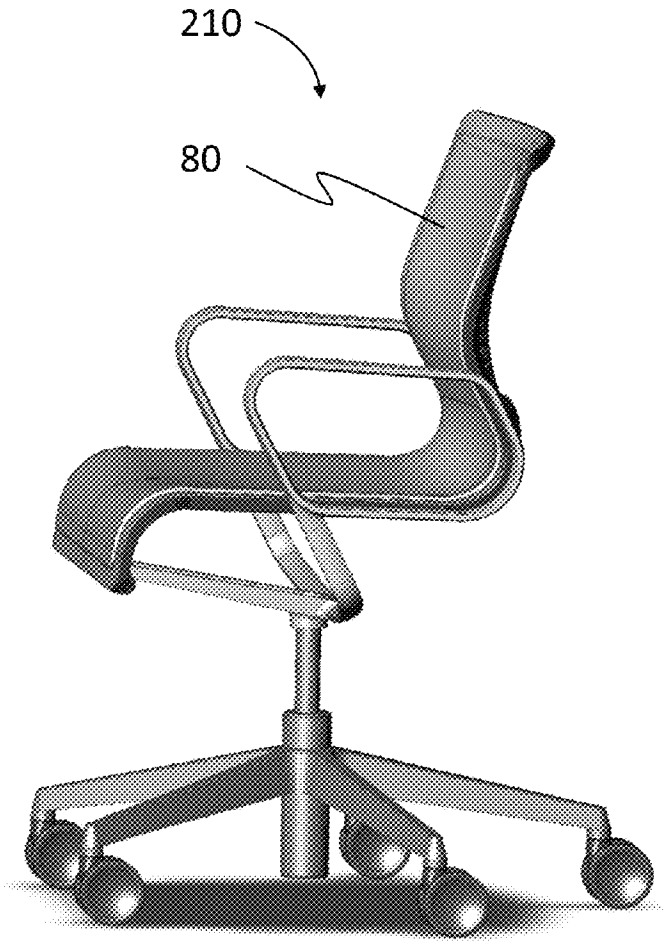
FIG. 20*b* is a side perspective view of the chair of FIG. 20*a* with the cushion of FIG. 19.
Figure 20A:
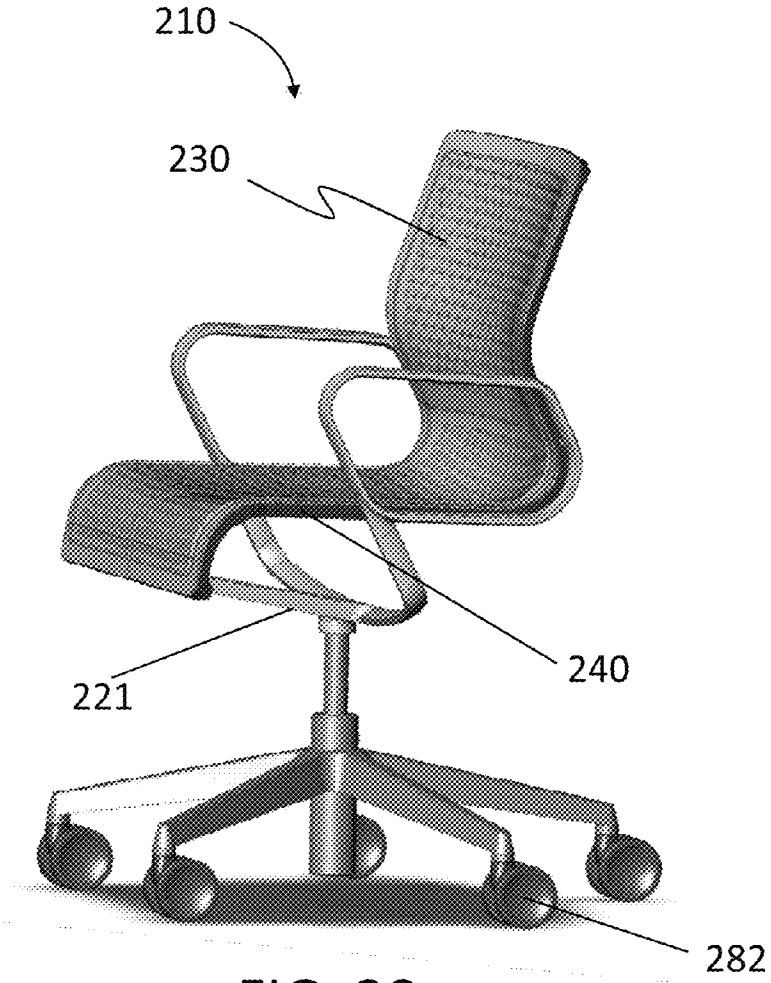
FIG. 20*a* is a side perspective view of yet another embodiment of a reclinable chair exemplifying the principles of the present invention.

FIG. 20*a* illustrates a task chair 210 embodying the principles of the present invention, wherein parts common with the chair 10 are denoted by like reference numerals increased by 200. The task chair 210 includes a flexible support surface 230 supported by a support frame 240 on a height adjustable swivel base 221 having a plurality of casters 282. FIG. 20*b* shows the chair 210 with a cushion 80 attached to the flexible support surface 230.

Figure 21:
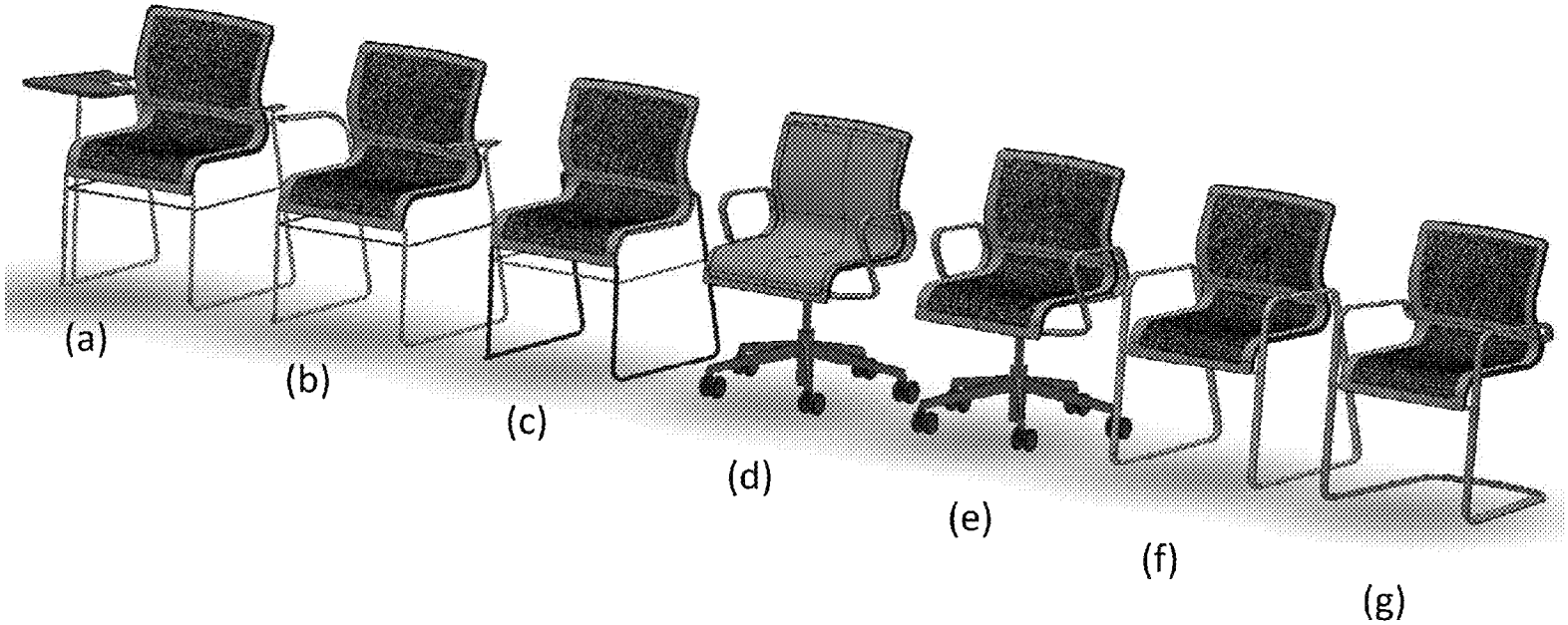
FIG. 21 is a front perspective view of a family of reclinable chairs exemplifying the principles of the present invention.

A family of exemplary chairs embodying the principles of the present invention is illustrated in FIG. 21. The common features between all chairs (a) to (g) within the exemplary family of chairs include the inventive recline mechanism, comprised of a support frame 40 that functions as a four-pivot linkage system, and the flexible support surface supported on the support frame. Chair (c) is the chair 10 illustrated above and chairs (a) and (b) are variations thereof: chair (b) including a pair of armrests extending from the base, and chair (a) including an armrest and an opposing desktop extending from the base. Chairs (d) to (g) include variations of the base: chairs (d) and (e) being the task chairs 210 of FIGS. 20*b* and 20*a*, respectively; chair (f) including a loop frame base, which also functions as a pair of armrests; and chair (g) including what is commonly referred to in the art as a cantilever base, which also functions as a pair of armrests.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention.

What is claimed is:

1. A reclinable chair comprising:

a base having a front end and a rear end;

a support frame mounted to the base such that the base and the support frame cooperatively function as a linkage system capable of providing a recline mechanism, the support frame comprising: a back frame portion having an upper end, a lower end, and opposing fulcrum attachment sites positioned between the upper and lower ends; a seat frame portion having a front end and a rear end; and a curved front frame portion having a front end and a rear end;

wherein the rear end of the base is attached to the opposing fulcrum attachment sites of the back frame portion to define a first pivot axis about which the back frame portion pivots;

wherein the front end of the base is attached to the front end of the of the curved front frame portion to define a second pivot axis;

wherein the lower end of the back frame portion is pivotally connected to the rear end of the seat frame portion by a first pair of opposing hinges to define a third pivot axis;

wherein the rear end of the curved front frame portion is pivotally connected to the front end of the seat frame portion by a second pair of opposing hinges to define a fourth pivot axis; and wherein the reclinable chair does not include a mechanical recline resistance device connected to the support frame.

2. The reclinable chair of claim 1, wherein the back frame portion is S-shaped and comprises an upper back support section and a lower curved section.

3. The reclinable chair of claim 2, wherein the opposed fulcrum attachment sites are positioned at a juncture of the upper back support section and the lower curved section of the back frame portion.

4. The reclinable chair of claim 1, further comprising a support surface mounted to the support frame.

5. The reclinable chair of claim 1, wherein the first pair of opposing hinges comprise a reclined position stopper.

6. A reclinable chair comprising:

a) a chair base comprising a base front end and a base rear end;

b) an articulating support frame mounted to the chair base such that the chair base and the support frame cooperatively function as a linkage system capable of providing a recline mechanism, the articulating support frame comprising:

i) a back frame portion, the back frame portion being pivotally attached to the base rear end at a position between an upper end and a lower end of the back frame portion to define a rear fulcrum about which the back frame portion pivots;

ii) a curved front frame portion, the curved front frame portion having a front end pivotally attached to the base front end to define a front fulcrum about which the curved front frame portion pivots;

iii) a seat frame portion disposed between and connecting the curved front frame portion to the back frame portion, with a rear end of the seat frame portion being pivotally connected to the lower end of the back frame portion, and with a front end of the seat frame portion being pivotally connected to a rear end of the curved front frame portion;

c) a support surface mounted to the articulating support frame; and d) wherein the reclinable chair does not include either a spring or gas cylinder coupled to the back frame portion of the articulating support frame.

7. The reclinable chair of claim 6, wherein the back frame portion comprises opposing back frame side edges having an S-shaped profile.

8. The reclinable chair of claim 6, wherein the articulating support frame comprises an upright position and a reclined position, wherein the seat frame portion is elevated in the reclined position.

9. The reclinable chair of claim 8, wherein the support surface comprises a one-piece flexible support surface.

10. The reclinable chair of claim 8, wherein the support surface comprises a backrest portion and a seat portion.

11. A reclinable chair comprising a recline mechanism, the recline mechanism comprising:

a) an articulating support frame comprising:

i) a back frame portion having an upper end and a lower end;

ii) a front frame portion having a front end and a rear end;

iii) a seat frame portion disposed between and connecting the front frame portion to the back frame portion, the seat frame portion having a rear end pivotally connected to the lower end of the back frame portion by a first pair of opposing hinges, and the seat frame portion having a front end pivotally connected to the rear end of the curved front frame portion by a second pair of opposing hinges;

b) a chair base comprising a base front end and a base rear end, wherein the base front end is pivotally connected to the front end of the front frame portion to define a front fulcrum about which the front frame portion pivots, and wherein the base rear end is pivotally connected to the back frame portion at a position between the upper and lower ends of the back frame portion to define a rear fulcrum about which the back frame portion pivots;

wherein the recline mechanism does not include a mechanical recline resistance device coupled to the articulating support frame.

12. The reclinable chair of claim 11, wherein the articulating support frame comprises an upright position and a reclined position, and wherein the seat frame portion is elevated in the reclined position.

13. The reclinable chair of claim 12, wherein the back frame portion comprises opposing back frame side edges, the back frame side edges having an S-shaped profile.

14. The reclinable chair of claim 12, wherein the back frame portion comprises an upper back support section and a lower curved section, wherein the upper back support section moves rearwardly and the lower curved section moves forwardly as the articulating support frame transitions from the upright position to the reclined position.

15. The reclinable chair of claim 14, further comprising a backrest mounted to the back frame portion.

16. The reclinable chair of claim 15, further comprising a seating surface mounted to the seat frame portion.

* * * * *